US011765495B2

(12) United States Patent
Pine et al.

(10) Patent No.: US 11,765,495 B2
(45) **Date of Patent: *Sep. 19, 2023**

(54) WIRELESS EARBUD

(71) Applicant: Amazon Technologies, Inc., Seattle, WA (US)

(72) Inventors: Jordan Pine, San Jose, CA (US); Josue Jean Rodriguez, Hialeah, FL (US); Aashish Nataraja, Santa Clara, CA (US); Amita Pawar, Sunnyvale, CA (US); Giovanni Mata Magana, East Palo Alto, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/462,715

(22) Filed: Aug. 31, 2021

(65) Prior Publication Data

US 2021/0400370 A1 Dec. 23, 2021

Related U.S. Application Data

(63) Continuation of application No. 17/032,895, filed on Sep. 25, 2020, now Pat. No. 11,134,329, which is a (Continued)

(51) Int. Cl.
*H04R 25/00* (2006.01)
*H04R 1/10* (2006.01)

(52) U.S. Cl.
CPC ..... *H04R 1/1016* (2013.01); *H04R 1/1025* (2013.01); *H04R 1/1041* (2013.01); *H04R 1/1058* (2013.01); *H04R 2201/10* (2013.01)

(58) Field of Classification Search
CPC .. H04R 1/1016; H04R 1/1025; H04R 1/1041; H04R 1/1058; H04R 2201/10
(Continued)

(56) References Cited

U.S. PATENT DOCUMENTS 10,206,026 B2 2/2019 Yeung et al.
2002/0021800 A1 2/2002 Bodley et al.
(Continued)

FOREIGN PATENT DOCUMENTS

CN 202488657 10/2012
CN 205829959 12/2016
(Continued)

OTHER PUBLICATIONS

Office Action for U.S. Appl. No. 17/032,895, dated Jan. 11, 2021, Pine, "Wireless Earbud", 10 Pages.
(Continued)

*Primary Examiner* — Phylesha Dabney
(74) *Attorney, Agent, or Firm* — Lee & Hayes, P.C.

(57) ABSTRACT

A wireless earbud including an outer housing, an internal assembly, and an inner housing. The outer housing and the inner housing may couple together to form a water tight enclosure for the internal assembly. The internal assembly may include components that carry out a function of the wireless earbud, such as printed circuit boards, network interfaces, batteries, loudspeakers, and so forth. The outer housing may also include a proximity sensor for receiving touch and/or antenna(s) for communicatively coupling the wireless earbud to other electronic devices. Additionally, the inner housing may include a charging module for the wireless earbud.

20 Claims, 23 Drawing Sheets

Related U.S. Application Data continuation of application No. 16/455,159, filed on Jun. 27, 2019, now Pat. No. 10,827,249.

(58) Field of Classification Search
USPC ..... 381/380
See application file for complete search history.

(56) References Cited

U.S. PATENT DOCUMENTS

| | | | |
|---|---|---|---|
| 2005/0201585 | A1 | 9/2005 | Jannard et al. |
| 2013/0070935 | A1 | 3/2013 | Hui et al. |
| 2017/0078784 | A1 | 3/2017 | Rye et al. |
| 2018/0352320 | A1 | 12/2018 | In et al. |
| 2021/0014598 | A1 | 1/2021 | Pine et al. |

FOREIGN PATENT DOCUMENTS

| | | |
|---|---|---|
| CN | 206759678 | 12/2017 |
| CN | 206790679 | 12/2017 |
| JP | 2010056763 | 3/2010 |

OTHER PUBLICATIONS

PCT Invitation to Pay Fees mailed on Sep. 4, 2020 for PCT Application No. PCT/US2020/038985, "Wireless Earbud", 14 pages.
PCT Search Report and Written Opinion dated Oct. 26, 2020 for PCT application No. PCT/US20/38985, 21 pages.
International Preliminary Report on Patentability for PCT Application No. PCT/US20/38985, dated Jan. 6, 2021.

WIRELESS EARBUD

CROSS-REFERENCE TO RELATED APPLICATION

This patent application is a continuation of and claims priority to U.S. patent application Ser. No. 17/032,895, filed Sep. 25, 2020, which is a continuation of U.S. patent application Ser. No. 16/455,159, filed Jun. 27, 2019, now U.S. Pat. No. 10,827,249, issued Nov. 3, 2020, which are fully incorporated herein by reference.

BACKGROUND

Headphones traditionally include wires that connect to an audio source, such as a music player. Other headphones are wireless and do not include a cable, but instead wirelessly receive a stream of audio data from an audio source. Wireless headphones, however, may have poor acoustic performances, large form factors, and may be uncomfortable to wear for extended periods of time. Additionally, wireless headphones may be susceptible to damage from impacts, such as being dropped. Further, moisture within the wireless earbud may degrade audio characteristics and/or damage components of the wireless headphones.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference number in different figures indicates similar or identical items.

DETAILED DESCRIPTION

Figure 1:
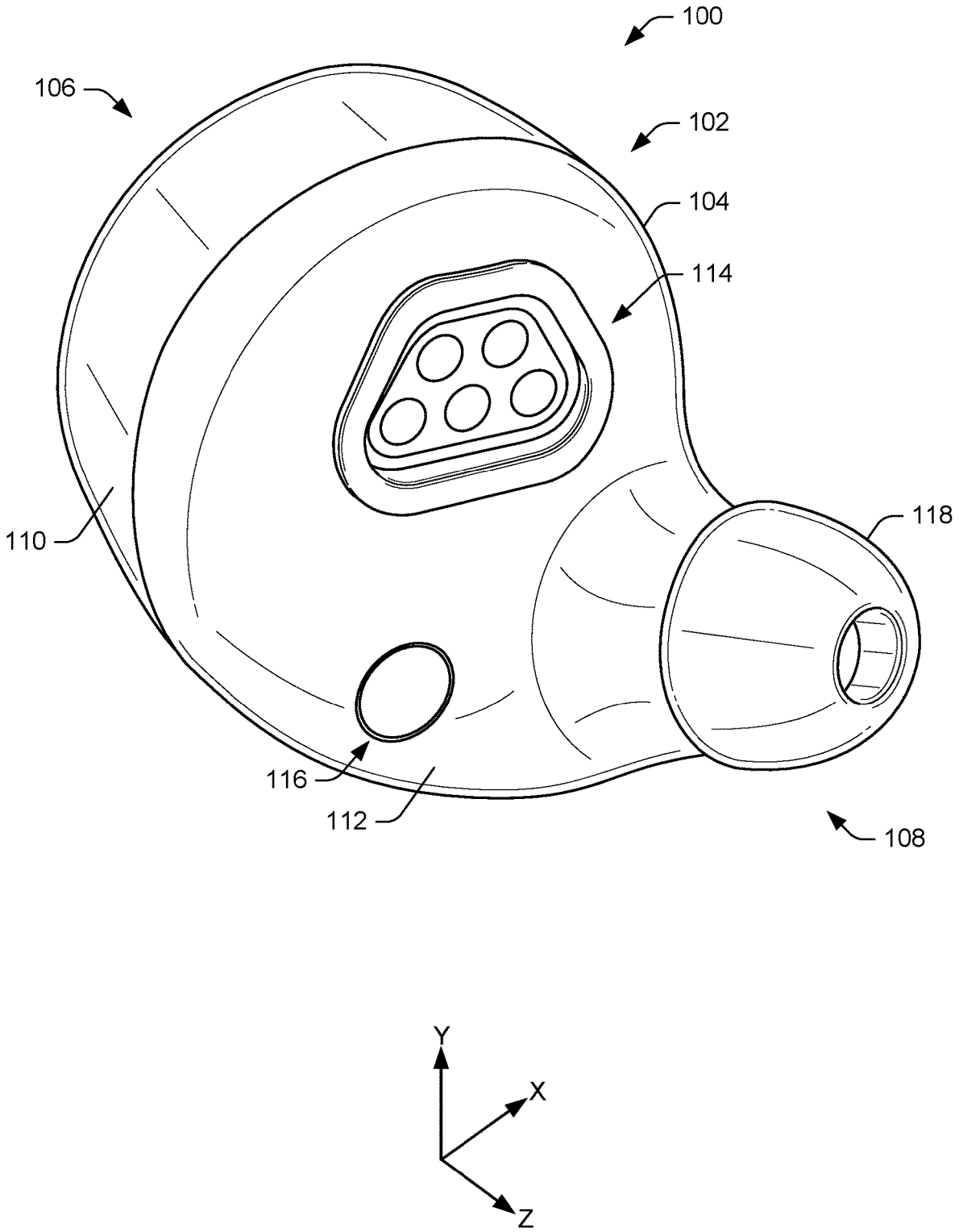
FIG. 1 illustrates a first perspective view of an example earbud, according to an embodiment of the present disclosure.

This application describes lightweight and compact wireless earbuds having improved audio characteristics. In some instances, the wireless earbuds may resemble earbud headphones that fit within the ear and/or ear canal of a user or may include other forms of wireless headphones (e.g., over-ear, on-ear, etc.). One or more of the wireless earbuds may be in communication with an electronic device, such as a mobile device (e.g., phone, tablet, laptop, etc.), and the wireless earbuds may include multiple (e.g., two, three, etc.) wireless earbuds that are synched, paired, or otherwise in communication with one another. For example, the wireless earbuds may include a first wireless earbud and a second wireless earbud (collectively referred to as the "wireless earbuds" or singularly as the "wireless earbud"). In some instances, the first wireless earbud may receive audio data from the electronic device for output on a loudspeaker of the first wireless earbud. The first wireless earbud may also transmit the audio data to the second wireless earbud for output. In some instances, the first wireless earbud and the second wireless earbud may include similar features, components, and/or may be physically indistinguishable. However, in some instances, the first wireless earbud may include structural features or form factors to reside within the left ear of a user, while the second wireless earbud may include structural features or form factors to reside within the right ear of the user.

In some instances, the wireless earbud (e.g., the first wireless earbud and/or the second wireless earbud) may include an outer housing assembly, an internal assembly, and/or an inner housing assembly. When assembled together, the outer housing assembly, the internal assembly, and the inner housing assembly may form the wireless earbud. In some instances, the outer housing assembly and the inner housing assembly may couple together to form a body or exterior of the wireless earbud. The internal assembly may be disposed between or within the outer housing assembly and the inner housing assembly, within an interior of the wireless earbud. In this sense, the internal assembly may occupy a space or cavity disposed between the outer housing assembly and the inner housing assembly, internal to the exterior of the wireless earbud.

In some instances, the outer housing assembly and the inner housing assembly may couple together via attachment mechanism(s) on the outer housing assembly operably engaging with attachment mechanism(s) on the inner housing assembly. In some instances, the attachment mechanism(s), respectively, may include snap-fits, magnets, mechanical fasteners, pressure fit, and/or a combination thereof. Additionally, in some instances, the outer housing assembly and the internal housing assembly may couple together using adhesives. The coupling between the outer housing assembly and the inner housing assembly may form a water-tight seal to prevent or inhibit moisture reaching components within the interior of the wireless earbud, such as components of the internal assembly.

In some instances, the outer housing assembly, the internal assembly, and/or the inner housing assembly may include alignment elements that position, locate, or otherwise align the outer housing assembly, the internal assembly, and/or inner housing assembly relative to one another. For example, the outer housing assembly may include tabs, ribs, struts, slits, flanges, pins, prongs, or features that engage with corresponding tabs, ribs, struts, slits, flanges, pins, prongs, or features on the inner housing assembly. The internal assembly may additionally, or alternatively, include such features. In some instances, the alignment elements may permit the outer housing assembly, the internal assembly, and/or the inner housing assembly to couple or otherwise fit together.

In some instances, the outer housing assembly may include an outer housing (or first housing), antenna(s), a proximity sensor (e.g., capacitive sensor, pressure sensor, membrane sensor, etc.), and/or microphone port(s). The outer housing may include an exterior surface that forms part of the exterior of the wireless earbud, and an interior surface having a cavity for receiving the internal assembly. In some instances, the exterior surface of the outer housing may include the antenna(s) and the interior surface may include the proximity sensor. The antenna(s) may communicatively couple the wireless earbud to another wireless earbud and/or electronic devices (e.g., mobile device). The proximity sensor may provide an interface for a user of the wireless earbud to control or request certain actions, such as requesting the wireless earbud to play music, answer phone calls, and so forth. In some instances, the antenna(s) and/or the proximity sensor may be formed directly onto the exterior surface and the interior surface of the outer housing, respectively, using laser direct structuring (LDS). For example, with LDS, the antenna(s) and/or the proximity sensor may be lasered directly onto the exterior surface and the interior surface of the outer housing.

The microphone port(s) may extend through a thickness of the outer housing, between the exterior surface and the interior surface, to direct sound external to the wireless earbud to within the interior of the wireless earbud. Microphones disposed within the wireless earbud may receive the sound and generate corresponding audio data. For example, the microphone port(s) may direct sound associated with user commands towards the microphones.

In some instances, the internal assembly may include a midframe and components that perform or otherwise carry out functions of the wireless earbud. For example, the internal assembly may include a battery, microphone(s) (e.g., out-of-ear and in-ear), shielding foams, a near field magnetic induction (NFMI) coil, network interface(s) (e.g., NFMI, Bluetooth, Bluetooth Low Energy (BLE), etc.), memory, processor(s), multi-layered board(s) (MLBs), flexible printed circuits (FPCs), flexible printed circuit assemblies (FPCAs), printed circuit board assemblies (PCBAs), and/or printed circuit boards (PCBs). In some instances, the components may couple to and/or reside within and/or on the midframe. For example, the midframe may include a cavity for receiving the battery and/or a slot for receiving the NFMI coil, which in some instances, may be oriented perpendicularly or orthogonal to the PCBs. Additionally, in instances where the wireless earbud includes more than one PCB, respective PCBs may reside on opposing sides of the midframe and may communicatively connect via a flex connector or flex circuit. For example, a first PCB may couple to a first side of the midframe and a second PCB may couple to a second side of midframe. In such instances, the battery may be interposed between the first PCB and the second PCB and the flex circuit may couple the first PCB and the second PCB. Further, the microphone(s) may reside on one or more of the PCBs of the internal assembly to receive sound via the microphone port(s) extending through the outer housing.

In some instances, the inner housing assembly may include an inner housing (or second housing), a charging module, an infrared (IR) sensor, microphone(s), a balanced armature (BA) driver and/or loudspeaker, and/or an eartip. The inner housing includes an exterior surface, which forms part of the exterior of the wireless earbud, and an interior surface or cavity for receiving components of the inner housing assembly. The inner housing may also include openings that extend through a thickness of the inner housing. For example, the inner housing may include an opening for the charging module to receive power from an external charger, or case that stores the wireless earbud(s). The charging module may couple to one or more of the PCBs to transfer power to the battery (via charging circuitry). However, in some instances, the wireless earbud may employ wireless charging (e.g., via inductive charging or sealed electrical contacts).

The inner housing may include an additional opening to accommodate the IR sensor. In some instances, the IR sensor (e.g., transmitter and receiver) may measure a heart rate and/or other physiological features of a user wearing the wireless earbud. Additionally, or alternatively, the IR sensor may detect a proximity of the wireless earbud to the user. For example, the IR sensor may measure a proximity of the wireless earbud to the user, or may determine whether the wireless earbud is being worn. In such instances, the proximity of the wireless earbud to the user may power components of the wireless earbud. For example, logic of the wireless earbud may receive signals from the IR sensor, and if worn, may power components of the wireless earbud. Additionally, or alternatively, the wireless earbud may include an idle state and an active state. In some instances, based on detecting that the wireless earbud is being worn, or is in the ear of the user, the wireless earbud may transition from the idle state to an active state. In the active state, the wireless earbud may have increased functionality, such as detecting input at the proximity sensor, communicatively coupling other devices, responding to user commands, and so forth.

The microphone(s) of the internal assembly may receive sound generated from the user and emanating from the ear canal. In some instances, the wireless earbud may utilize acoustic isolation between audio captured external to the user, such as within an environment of the user (e.g., out-of-ear microphone), and audio captured within the ear canal (e.g., in-ear microphone), to prevent the wireless earbud from capturing substantially the same sound. Through acoustic isolation, audio data captured by the wireless earbud may represent sounds that were emitted by the user.

The BA driver may correspond to a loudspeaker of the wireless earbud and may receive an electrical current for outputting corresponding audio. For example, changes or variations in the current may cause an attraction between coils and magnets of the BA driver. Such variations may drive an armature to produce or generate sound. The inner housing accordingly includes an opening disposed adjacent to the BA driver to emit sound. For example, the opening may be located at a tip or end of the inner housing that is sized and configured to reside within the ear canal of the user. The eartip may couple to the end of the inner housing, adjacent to the opening, to hold the wireless earbud comfortably and securely within the ear canal of the user.

As noted above, the outer housing assembly, the internal assembly, and the inner housing assembly may be assembled together to form the wireless earbud. Once assembled, the wireless earbud may have a smooth, compact, and aesthetic appearance. Additionally, the outer housing assembly, the internal assembly, and the inner housing may form a compact enclosure with minimal space to reduce a size of the wireless earbud. For example, LDS may reduce a profile and/or weight of the wireless earbud. In such instances, given the compact nature, the wireless earbud may include heat dissipating plates to dissipate heat and prevent the wireless earbud overheating. Additionally, in some examples, wireless earbuds according to this application may be waterproof or water-resistant. For instance, the coupling between the outer housing and the inner housing may form a watertight enclosure for components of the wireless earbud (e.g., PCBs). Additionally, openings within the outer housing and/or the inner housing, such as the microphone port(s), may be sealed to prevent or inhibit ingress of liquids or other moisture. For example, mesh or other material may cover the openings to allow sound to enter and exit the wireless earbud while at the same time, may inhibit the ingress of liquids or other moisture (e.g., sweat). In some instances, seams of the wireless earbud, such as between the inner housing and the outer housing, may be sealed with adhesives. The wireless earbud may also include foam or padding (e.g., open-cell foam) that prevents against damage caused by impacts, such as if the wireless earbud is dropped. In some instances, the foam may prevent the first PCB and/or the second PCB from touching the battery and shorting.

While these, and additional examples and details of the wireless earbud is discussed in detail herein, the techniques and structures may be applied to a wide variety of electronic devices. Examples of electronic devices include, by way of example and not limitation, mobile phones (e.g., cell phones, smart phones, etc.), tablet computing devices, electronic book reader devices, laptop or all-in-one computers, media players, portable gaming devices, televisions, monitors, cameras, wearable computing devices, electronic picture frames, audio virtual assistant devices, radios, speakers, personal computers, external hard drives, input/output devices (e.g., remote controls, game controllers, keyboards, mice, touch pads, microphones, speakers, etc.), and the like.

The present disclosure provides an overall understanding of the principles of the structure, function, device, and system disclosed herein. One or more examples of the present disclosure are illustrated in the accompanying drawings. Those of ordinary skill in the art will understand that the devices and/or the systems specifically described herein and illustrated in the accompanying drawings are non-limiting embodiments. The features illustrated or described in connection with one embodiment may be combined with the features of other embodiments. Such modifications and variations are intended to be included within the scope of the appended claims.

FIG. 1 illustrates a first perspective view on an example wireless earbud 100. In some instances, the wireless earbud 100 may represent an earbud worn in the left ear of a user. However, while the discussion herein may relate to the wireless earbud 100 worn in the left ear of the user, it is understood that an earbud worn in the right ear of the user may include similar features, or corresponding features that permit or configure the wireless earbud to be worn and secured in the right ear of the user.

In some instances, FIG. 1 may illustrate an inside of the wireless earbud 100 that faces or is oriented towards the user when worn. The wireless earbud 100 may include a body 102 having an exterior surface 104 that extends between a first end 106 and a second end 108. In some instances, the exterior surface 104 is formed from coupling two cases, frames, or housings together. For example, the wireless earbud 100 may include an outer housing 110 (or first housing) and an inner housing 112 (or second housing) that couple together to form the body 102 and/or exterior surface 104. In this sense, the outer housing 110 may include an exterior surface that forms at least a portion of the exterior surface 104 of the wireless earbud 100 and the inner housing 112 may include an exterior surface that forms at least a portion of the exterior surface 104. Once assembled, the exterior surface 104 may be a uniform or continuous surface to provide the wireless earbud 100 with an aesthetic appearance.

The wireless earbud 100 may include a charging assembly, unit, or module 114 that couples to a charger to charge one or more batteries of the wireless earbud 100. For example, the charging module 114 may couple to the charger to transfer energy to one or more PCBs of the wireless earbud 100. In turn, the one or more PCBs may charge the one or more batteries (via charging circuitry). In some instances, the charging module 114 may be disposed through or reside within an opening of the inner housing 112. Accordingly, the opening of the inner housing 112 may accommodate or expose the charging module 114 for coupling to the charger.

In some instances, the charger may be included within a case for storing, transporting, or holding the wireless earbud(s). For example, in some instances, wireless earbuds (e.g., pair) may be sized and shaped to fit within a case that includes a rechargeable battery and/or charging circuitry. Additionally, or alternatively, the case may receive mains power from a power outlet. In some instances, the wireless earbuds may be charged when a detector of the case, or the wireless earbud 100, detects when the wireless earbud 100 is placed within the case or are otherwise coupled to a charger.

In some instances, the wireless earbud 100 may include an IR sensor 116 to measure physiological characteristics of a user wearing the wireless earbud 100. For example, the IR sensor 116 may be used to measure heart rate and/or temperature. Additionally, or alternatively, the IR sensor 116 may be used to measure or detect a proximity of the wireless earbud 100 to the user, such as the ear of the user. For example, the IR sensor 116 may be used to determine whether the wireless earbud 100 is being worn by the user, and if so, logic of the wireless earbud 100 may power certain components of the wireless earbud 100. Stated alternatively, if the wireless earbud 100 is not being worn by the user, the logic may not power certain components of the wireless earbud 100 to increase a battery life. In some instances, the IR sensor 116 may be disposed through or reside within an opening of the inner housing 112. In some instances, and as shown in FIG. 1, the IR sensor 116 and/or the corresponding hole in the inner housing 112, may be circular. The opening of the inner housing 112 may therefore allow the IR sensor 116 to orient towards the user when worn.

The second end 108 of the wireless earbud 100 may include an eartip 118. When the wireless earbud 100 is worn, the eartip 118 may reside within the ear canal of the user and may help secure the wireless earbud 100 to the user. Noted above, the wireless earbud 100 may represent an earbud worn in the left ear of the user. An earbud with similar features, however, may be worn in the right ear of the user. For example, with a right earbud, the eartip 118 may be located at a different location on the inner housing 112 (e.g., spaced apart in the X-direction as depicted in FIG. 1). Accordingly, a pair of wireless earbuds may include the wireless earbud 100 worn in the left ear, and an additional wireless earbud worn in the right ear of the user.

Figure 2:
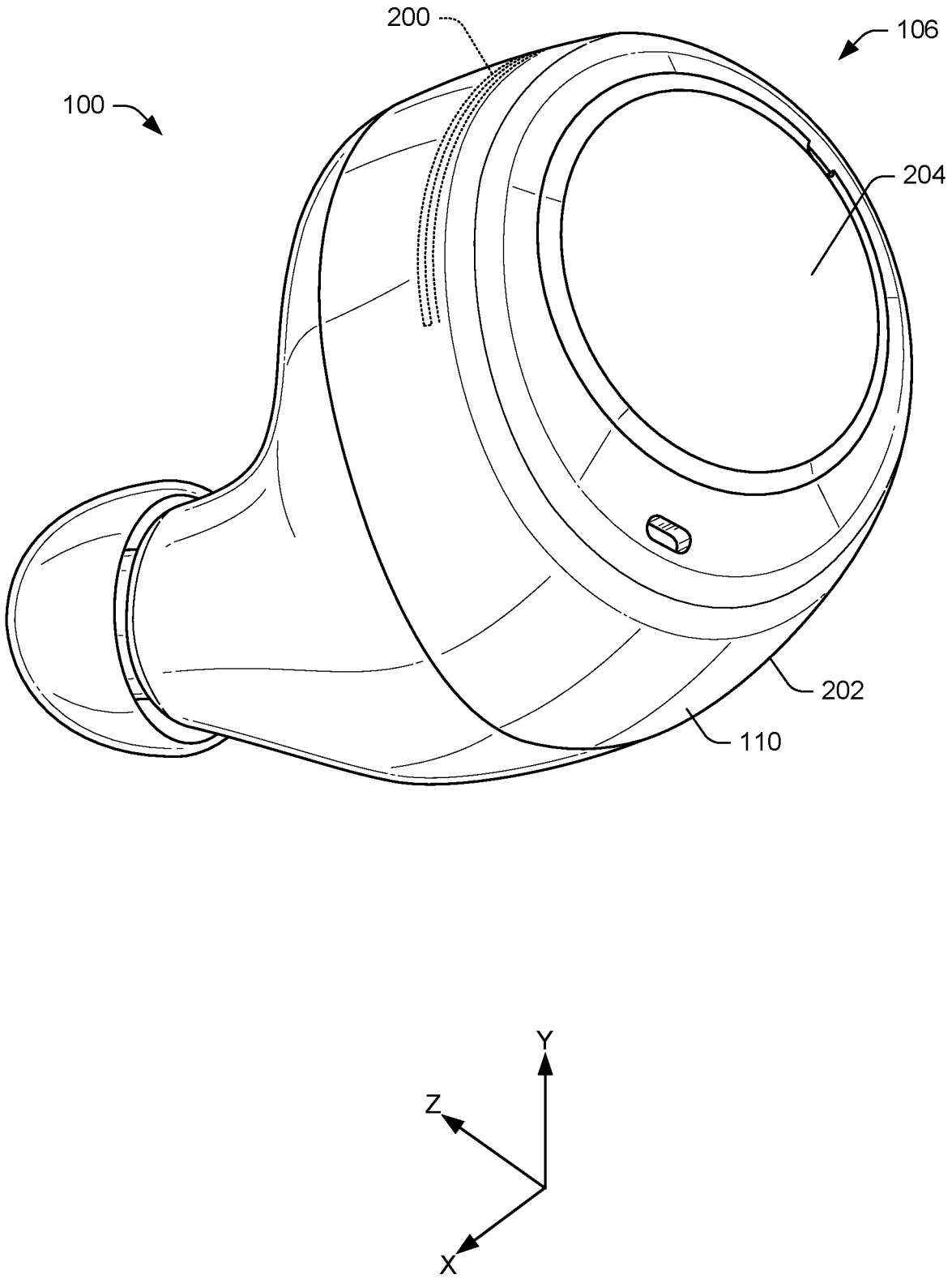
FIG. 2 illustrates a second perspective view of the earbud of FIG. 1, according to an embodiment of the present disclosure.

FIG. 2 illustrates a second perspective view of the wireless earbud 100. In some instances, FIG. 2 may represent an outside view of the wireless earbud 100 oriented away from the user when the wireless earbud 100 is worn. The first end 106 of the wireless earbud 100, such as outer housing 110, may include an antenna 200 for communicatively coupling the wireless earbud 100 to other computing devices. In some instances, the antenna 200 may be located at the first end 106, proximal to the first end 106, or disposed along a top of the outer housing 110, adjacent to the first end 106. The antenna 200 may correspond to an antenna for wireless interface(s) of the wireless earbud 100, such as ZigBee, Bluetooth, Wi-Fi, etc.

In some instances, the antenna 200 may not be visible, but instead, may be concealed or hidden by an exterior finish of the wireless earbud 100, such as paint. For example, as shown in FIG. 2, the antenna 200 is represented with dashed lines in order to illustrate its position beneath the exterior finish of the wireless earbud 100. In some instances, the antenna 200 may be directly integrated or printed on an exterior surface 202 of the outer housing 110. For example, after the outer housing 110 is produced (e.g., injection molding), a laser may scribe or etch a pattern associated with the antenna 200 onto exterior surface 202 of the outer housing 110. Those areas of the outer housing 110 that are etched, or structured using the laser, may be plated with a conductive material (e.g., metal) to form a circuit trace, which may form the antenna 200. As shown, in some instances, the antenna 200 may follow a curvature or arc of the outer housing 110, or the exterior surface 104, so as to wrap around or follow a periphery of the wireless earbud 100 at the first end 106 and/or proximate to the first end 106. Accordingly, the outer housing 110 may include material for permitting LDS, such as a thermal compound. In some instances, positioning the antenna 200 on the exterior surface 104, or proximate to an exterior of the wireless earbud 100, may increase a received signal strength when the wireless earbud 100 communicatively couples to computing devices (e.g., mobile device, access point (AP), etc.).

In some instances, first end 106 may include a disc 204 that couples to the outer housing 110. The disc 204 may provide an aesthetic appearance for the wireless earbud 100 and/or may be interchangeable to alter a finish or appearance of the wireless earbud 100 (e.g. color, texture, material, etc.). In some instances, as discussed herein, the wireless earbud 100 may include a proximity sensor for sensing input or a proximity of a user's finger, for example, to the exterior surface 104. In some instances, the user may touch the disc 204, which may be adjacent to the proximity sensor disposed in the interior of the outer housing 110. In some instances, the disc 204 may discharge static electricity of the user to prevent the static electricity transferring to components of the wireless earbud 100. Additionally, or alternatively, the outer housing 110 may further include conductive adhesives and/or metal plating for dissipating static electricity. In some instances, the metal plating may be within the interior of the outer housing 110.

Figure 3A:
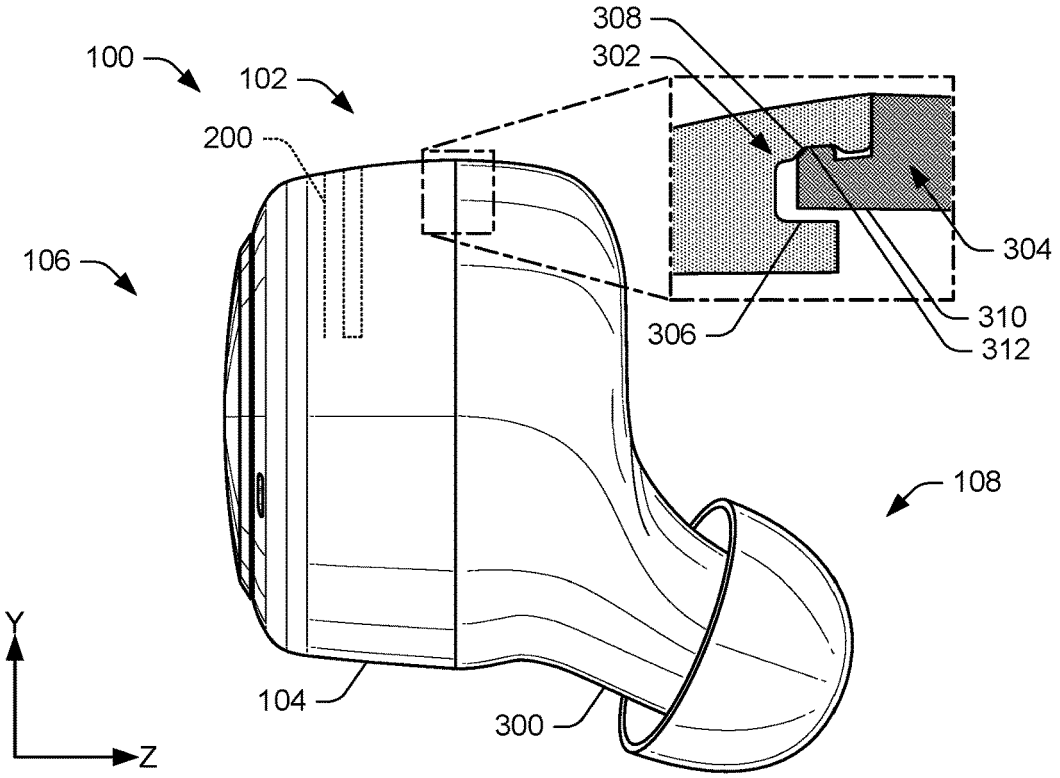
FIG. 3A illustrates a first side view of the earbud of FIG. 1, according to an embodiment of the present disclosure.
Figure 3B:
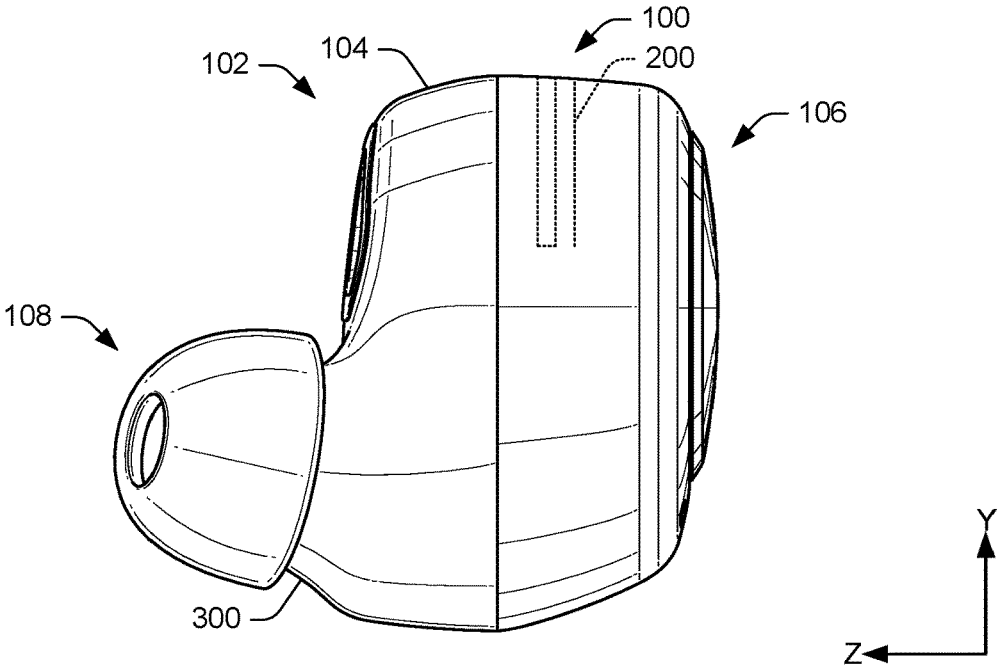
FIG. 3B illustrates a second view of the earbud of FIG. 1, according to an embodiment of the present disclosure.

FIGS. 3A and 3B illustrates a first side view and a second side view of the wireless earbud 100, respectively. In some instances, FIG. 3A may represent a front view of the wireless earbud 100, while FIG. 3B may represent a rear view of the wireless earbud 100. As shown, in some instances, the body 102 of the wireless earbud 100 may include a cylindrical shape or substantially cylindrical shape (X-Y direction). In some instances, the body 102 may include other shapes as well (e.g., hexagonal, square, spherical, and/or any combination thereof). At the second end 108, or proximate to the second end 108, the body 102 may include an elongated region, collar, or neck 300 that is sized and configured to at least partially or completely reside or fit within the ear canal of the user. As shown, the neck 300 may protrude or extend from a cylindrical or substantially cylindrical portion of the body 102 proximate to the second end 108. In other words, at the first end 106, the body 102 may be cylindrical, or substantially cylindrical, which may continue towards the second end 108 (e.g., Z-direction) before the body 102 tapers towards the second end 108 to form the neck 300.

As discussed above, the outer housing 110 and the inner housing 112 may interlock or couple together to form the body 102 and/or the exterior surface 104 of the wireless earbud 100. In some instances, coupling of the outer housing 110 and the inner housing 112 may come by way of snap-fit, magnets, mechanical fasteners, adhesion, pressure fit, or a combination thereof. For example, FIG. 3A illustrates a detailed cross-sectional view, taken along the Y-Z plane where the outer housing 110 and the inner housing 112 couple, to illustrate the attachment between the outer housing 110 and the inner housing 112. For example, the outer housing 110 may include a first attachment mechanism 302 and/or the inner housing 112 may include a second attachment mechanism 304. In some instances, the first attachment mechanism 302 and/or the second attachment mechanism 304 may resemble tabs, hooks, protrusions, keys, keyways, slots, or other male/female connectors that operably engage.

For example, as shown in FIG. 3A the first attachment mechanism 302 may include a slot 306 having a notch 308, while the second attachment mechanism 304 may include a protrusion 310 having a lip 312 that are configured to engage with the slot 306 and/or the notch 308, respectively, of the first attachment mechanism 302. In some instances, the protrusion 310 may slide into the slot 306 to at least partially reside within the slot 306 and the lip 312 may engage the notch 308. Such coupling may interlock the outer housing 110 and the inner housing 112. As discussed in detail herein, in some instances, the first attachment mechanism 302 may circumferentially extend around an annulus, rim, perimeter or opening of the outer housing 110, while the second attachment mechanism 304 may circumferentially extend around an annulus, rim, perimeter, or opening of the inner housing 112.

In some instances, the coupling between the outer housing 110 and the inner housing 112 may provide an impermeable, water resistant enclosure for components residing within an interior of the wireless earbud 100. Moreover, a seam, groove, or tolerance between the outer housing 110 and the inner housing 112 may inhibit the ingress of liquid or other moisture into the interior of the wireless earbud 100. Additionally, or alternatively, a seam between the outer housing 110 and the inner housing 112 may include a tortuous path that inhibits water or other moisture from traversing into the interior. Further, additionally or alternatively, the outer housing 110 and the inner housing 112 may couple via adhesives (e.g., pressure sensitive adhesive). For example, an adhesive may be applied to the seam between the outer housing 110 and the inner housing 112. In some instances, the adhesive may be applied onto the first attachment mechanism 302 and/or the second attachment mechanism 304 to increase a bonding strength between the outer housing 110 and the inner housing 112. In some instances, the adhesive may also water-proof the interior of the wireless earbud 100 or inhibit water from reaching internal components of the wireless earbud 100 and/or may provide impact resistance. In some instances, the adhesives may include acrylic and methyl methacrylate structural adhesives.

FIGS. 3A and 3B further illustrate the antenna 200 disposed at, or adjacent to, the first end 106 of the wireless earbud 100. As shown, in some instances, the antenna 200 may follow a curvature of the outer housing 110 and beneath the exterior surface 104 (as indicated by the dashed lines).

Figure 4A:
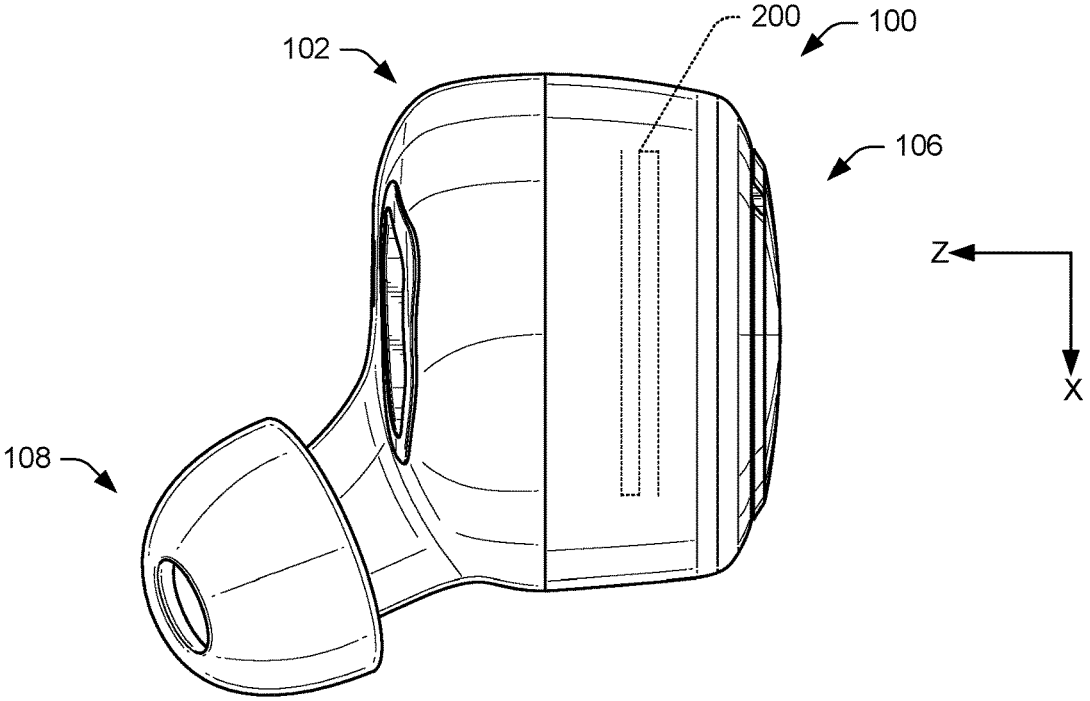
FIG. 4A illustrates a third side view of the earbud of FIG. 1, according to an embodiment of the present disclosure.
Figure 4B:
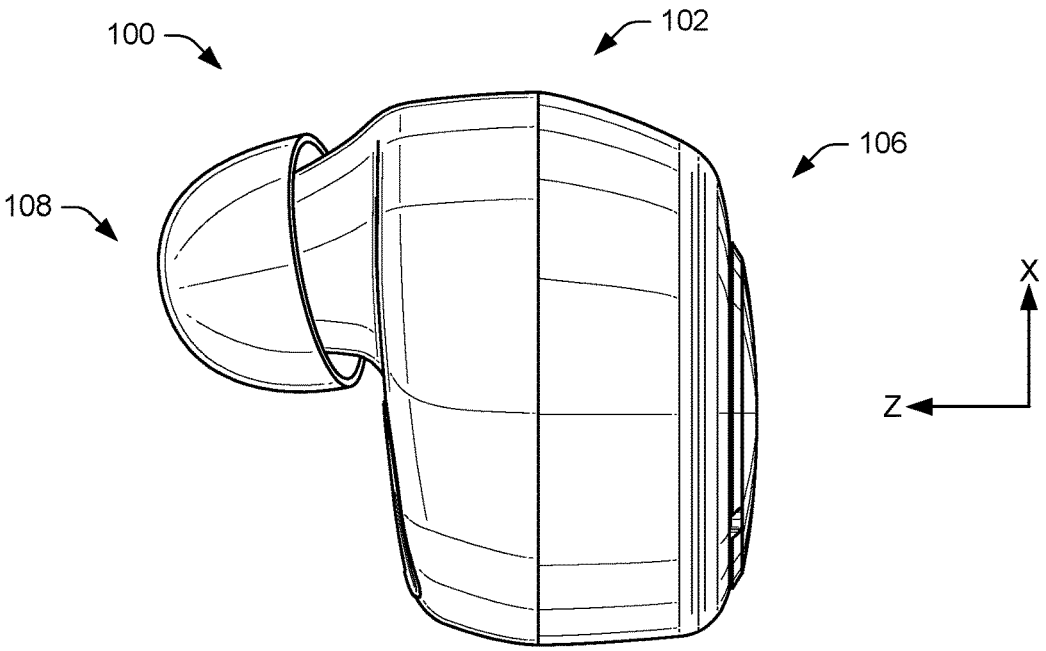
FIG. 4B illustrates a fourth side view of the earbud of FIG. 1, according to an embodiment of the present disclosure.

FIGS. 4A and 4B illustrates a third side view and a fourth side view of the wireless earbud 100, respectively. In some instances, FIG. 4A may represent a top view of the wireless earbud 100, while FIG. 4B may represent a bottom view of the wireless earbud 100. In some instances, at the first end 106, the body 102 may include a cylindrical or substantially cylindrical shape that may continue in a direction towards the second end 108 (e.g., Z-direction) before tapering to form the neck 300. The neck 300 may therefore extend from a cylindrical or substantially cylindrical portion of the body 102.

FIG. 4A further illustrates the antenna 200 disposed on the outer housing 110. In some instances, the antenna 200 may include other shapes, or profiles, than shown. Additionally, the antenna 200 may be located elsewhere on the wireless earbud 100 (e.g., top, bottom, front, back, sides, a combination thereof, etc.) and/or may include more or less traces than shown.

Figure 5:
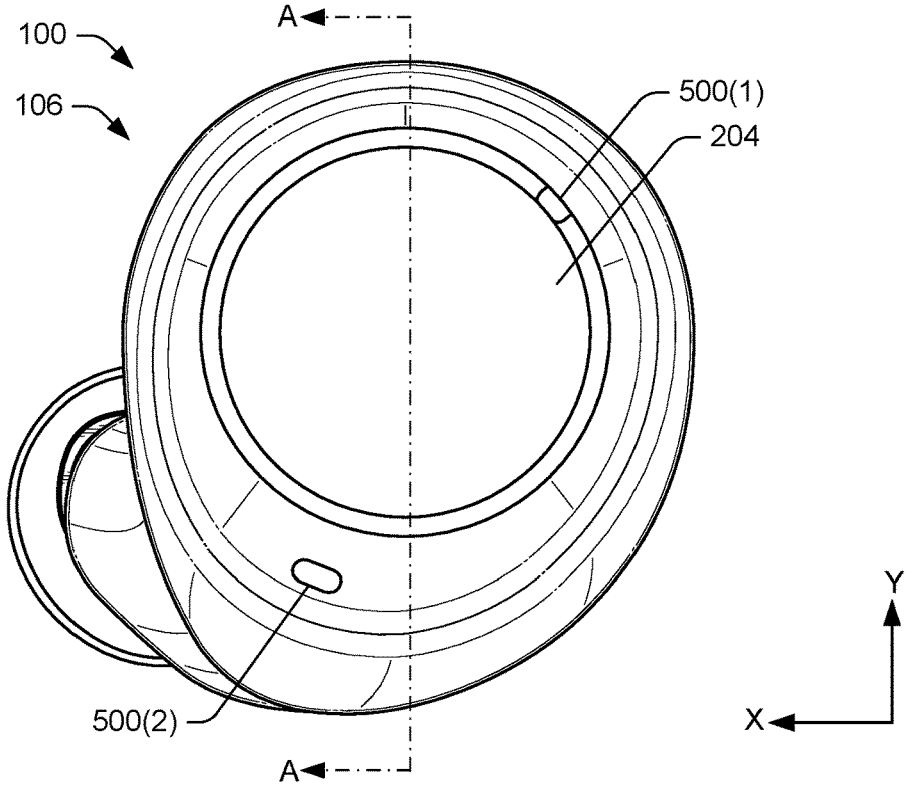
FIG. 5 illustrates a fifth side view of the earbud of FIG. 1, according to an embodiment of the present disclosure.

FIG. 5 illustrates a fifth side view of the wireless earbud 100, which in some instances, may represent a first end view of the wireless earbud 100. The first end 106 of the wireless earbud 100 may include the disc 204 coupled to the outer housing 110 (e.g., using adhesive, tape, etc.). As shown, in some instances, the disc 204 may include a circular shape or a substantially circular shape, however, the disc 204 may take other shapes and/or may be interchangeable to alter an aesthetic appearance of the wireless earbud 100. In some instances, the disc 204 may reside within a center of the outer housing 110.

The first end 106 may also include microphone port(s) 500(1) and 500(2) (collectively referred to as "the microphone port(s) 500") for channeling or directing sound exterior to the wireless earbud 100 to within the interior of the wireless earbud 100. In some instances, the microphone port(s) 500 may extend through a thickness of the outer housing 110. The microphone port(s) 500 may therefore transfer or direct sound that is external to the wireless earbud 100 to microphone(s) located within the wireless earbud 100. In some instances, the microphone(s) may be selected and/or designed for sensitivity to near-field and/or far-field to adjust audio captured based on which microphone(s) are closest to the user (e.g., beamforming). That is, the wireless earbud 100 may capture audio signals based on sound within the environment, which may include speech from a user. In some instances, the wireless earbud 100 may include a beamformer component that functions to apply one or more sets of beamformer coefficients to the audio signals to create beampatterns, or effective directions of gain or attenuation. In some instances, the volumes may be considered to result from constructive and destructive interference between signals from individual microphones of the wireless earbud 100. As is known and as used herein, "generating" an audio signal includes a microphone transducing audio waves of captured sound to an electrical signal and a codec digitizing the signal.

The wireless earbud 100 may also include functionality for applying different beampatterns to the generated audio signals from the different microphone(s) of the wireless earbud 100, with each beampattern having multiple lobes. By identifying lobes most likely to contain user speech, additional processing resources may be devoted to the portion of an audio signal most likely to contain user speech to provide better echo canceling and thus a cleaner SNR ratio in the resulting processed audio signal.

Application of the set of beamformer coefficients to the signal data results in processed data expressing the beampattern associated with those beamformer coefficients. Application of different beamformer coefficients to the signal data generates different processed data. Several different sets of beamformer coefficients may be applied to the audio data, resulting in a plurality of simultaneous beampatterns. Each of these beampatterns may have a different shape, direction, gain, and so forth.

In some instances, the beamformer coefficients may be pre-calculated to generate beampatterns with particular characteristics. Such pre-calculation may reduce overall computational demands. In other instances, the coefficients may be calculated on an on-demand basis. A given beampattern may be used to selectively gather signals from a particular spatial location where a signal source is present. The selected beampattern may be configured to provide gain or attenuation for the signal source. For example, the beampattern may be focused on a particular user's head, such as towards the mouth of the user, allowing for the recovery of the user's speech while attenuating noise from an operating air conditioner that is across the room and in a different direction than the user relative to a device that captures the audio signals. Such spatial selectivity by using beamforming allows for the rejection or attenuation of undesired signals outside of the beampattern. The increased selectivity of the beampattern improves signal-to-noise ratio for the audio signal. By improving the signal-to-noise ratio, the accuracy of speech recognition performed on the audio signal is improved.

In some instances, the microphone(s) and/or the microphone port(s) 500 may be acoustically sealed to prevent acoustic signals from interfering with those being received via other portions of the wireless earbud 100. Additionally, the microphone port(s) 500 may also be sealed or covered with an acoustic mesh or membrane material that prevents or substantially prevents the ingress of water or moisture into the interior of the wireless earbud 100, while allowing sound to permeate therethrough and reach the microphone(s). For example, in some instances, the mesh or membrane material may include polytetrafluoroethylene (FIFE), silicone rubber, metal, and/or a combination thereof having an ingress protection (IP) of 67 or 68 (i.e., IP67 and IP68). However, in some instances, the mesh or membrane material may have an IP below 67 or 68, such as IP61 or IP65.

As shown, the microphone port(s) 500 may be spaced apart from one another (X and Y-directions). In some instances, the microphone port(s) 500 may be located closer to a periphery or perimeter of the wireless earbud 100 than the disc 204. In other words, in some instances, the microphone port(s) may border, encase, encircle, or surround the disc 204. Although FIG. 5 illustrates the wireless earbud 100 including two microphone port(s) 500, the wireless earbud 100 or the outer housing 110 may include more than or less than two microphone port(s) 500 and/or the microphone port(s) 500 may be located or arranged differently than shown. In some instances, the disc 204 may include holes that accommodate or align with the microphone port(s) 500 to allow sound to pass therethrough.

Figure 6:
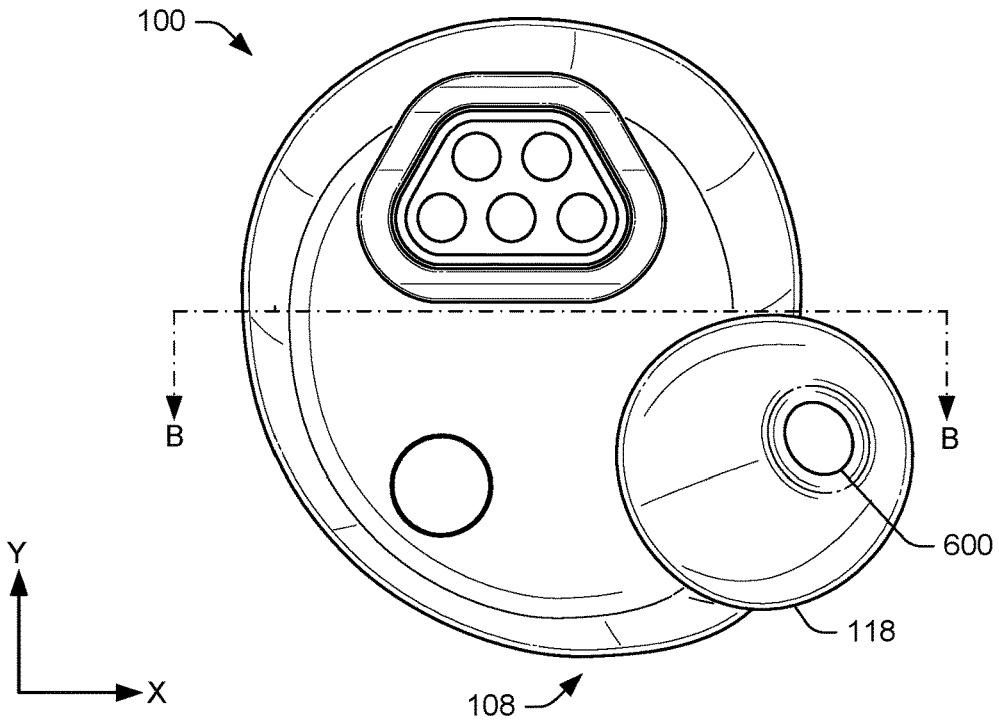
FIG. 6 illustrates a sixth side view of the earbud of FIG. 1, according to an embodiment of the present disclosure.

FIG. 6 illustrates a sixth side view of the wireless earbud 100, which in some instances, may represent a second end view of the wireless earbud 100. As shown, the second end 108 may include an opening 600 through which sound may exit from within an interior of the wireless earbud 100. For example, sound produced by one or more loudspeaker(s) (e.g., tweeter, mid-range, and/or woofer) may exit the wireless earbud 100 via the opening 600. As shown, the opening 600 may be formed or disposed at the second end 108 of the body 102 of the wireless earbud 100, or at an end of the neck 300. As discussed herein, the opening 600 may be sealed or covered with a mesh material that prevents or substantially prevents the ingress of water or moisture into the interior of the wireless earbud 100 (e.g., sweat), while allowing sound from the one or more loudspeaker(s) to pass therethrough. In some instances, the mesh material may include multiple layers, such as an adhesive layer, a metal mesh layer, and/or an acoustic layer. In some instances, the mesh material may have an IP67 or IP68 rating. Further, the eartip 118 includes a corresponding opening with the opening 600 that allows sound to exit the wireless earbud 100.

Figure 7:
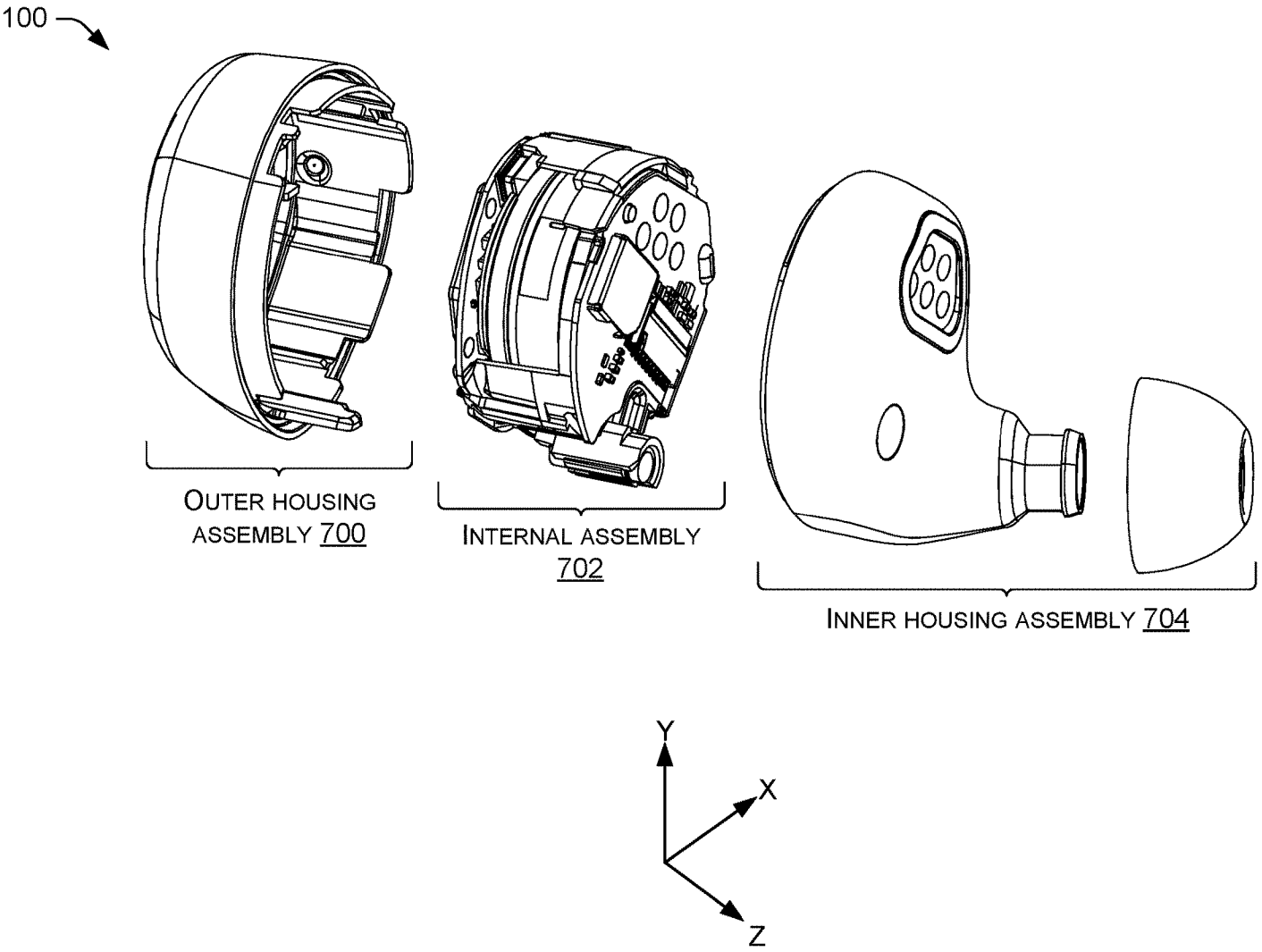
FIG. 7 illustrates a partially exploded view of the earbud of FIG. 1, showing example components of the earbud, according to an embodiment of the present disclosure.

FIG. 7 illustrates a partially exploded view of the wireless earbud 100, showing example components of the wireless earbud 100. In some instances, the wireless earbud 100 may include an outer housing assembly 700, an internal assembly 702, and/or an inner housing assembly 704. Discussed above, the outer housing assembly 700 may include the outer housing 110 having the antenna 200 and the microphone port(s) 500 and the inner housing assembly 704 may include the inner housing 112 having the charging module 114, the IR sensor 116, and/or the eartip 118. As discussed in detail herein, the internal assembly 702 may include one or more components that carry a function of the wireless earbud 100, such as microphone(s), network interface(s), PCBs, and so forth. The internal assembly 702 may occupy a space between the outer housing 110 and the inner housing 112, such that the outer housing 110 and the inner housing 112 surround or enclose the internal assembly 702. The internal assembly 702 may therefore reside within the interior of the wireless earbud 100. Once assembled, for instance, as shown in FIG. 1, the wireless earbud 100 may resemble a compact enclosure, potentially minimizing a size of the wireless earbud 100. In some instances, the compact nature of the wireless earbud 100, or the geometries of the wireless earbud 100, may prevent pooling of liquid or moisture.

Figure 8:
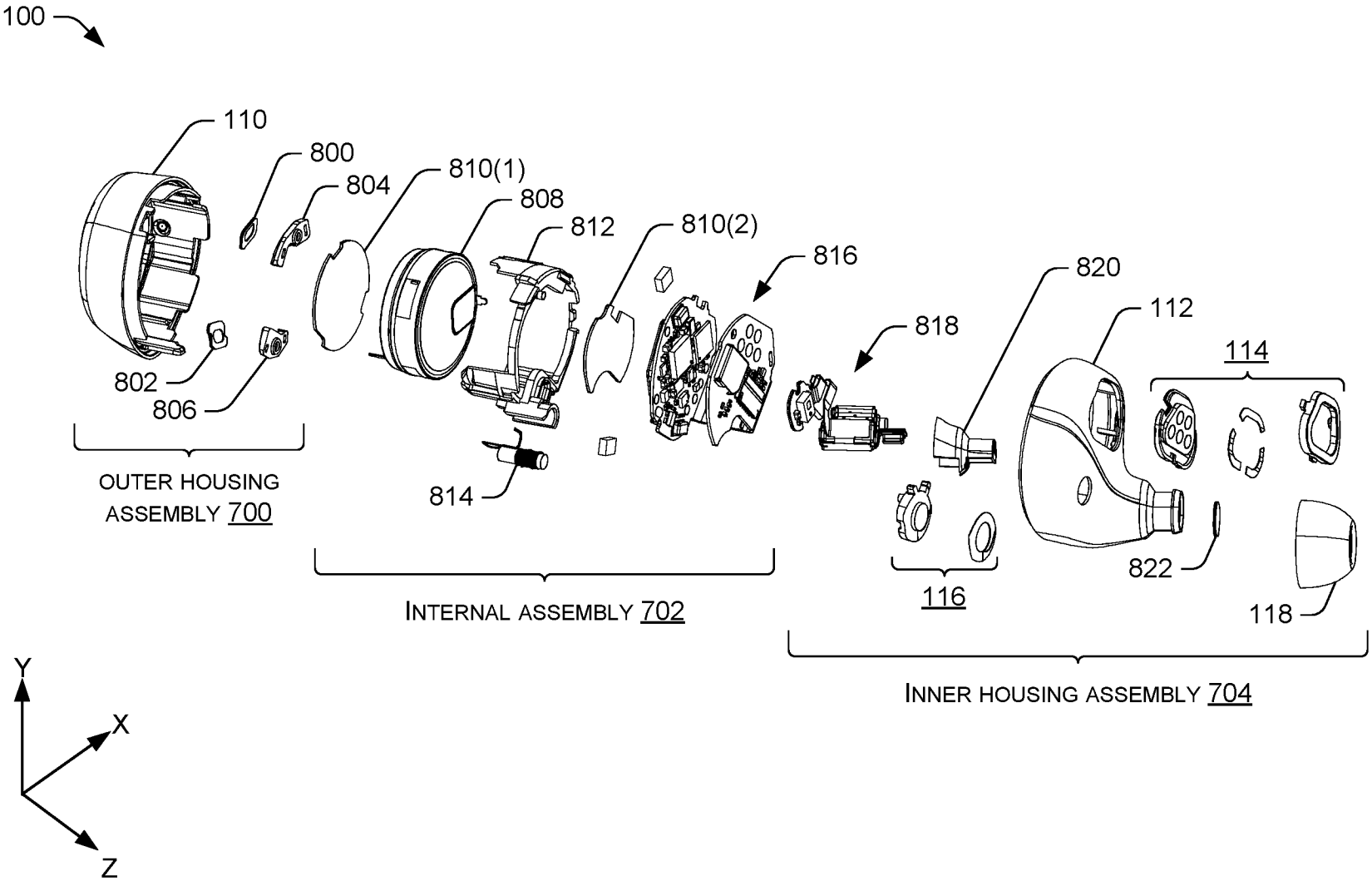
FIG. 8 illustrates an exploded view of the earbud of FIG. 1, showing example components of the earbud, according to an embodiment of the present disclosure.

FIG. 8 illustrates an exploded view of the wireless earbud 100. In some instances, the outer housing assembly 700 may include the outer housing 110, first microphone mesh 800, second microphone mesh 802, a first microphone boot 804, and a second microphone boot 806. Noted above, the outer housing assembly 700 may further include the antenna 200 and the microphone port(s) 500 disposed on or through the outer housing 110, respectively.

The internal assembly 702, may in some instances, include a battery 808, battery foam 810(1) and/or 810(2) (collectively referred to as "the battery foam 810"), a midframe 812, a NFMI coil 814 (e.g., ferrite rod wound with copper wire), and a PCBA 816. As discussed herein, the battery 808 may reside within a cavity of the midframe 812 and the battery foam 810 may be disposed on either or both sides of the battery 808. The battery foam 810 may prevent the PCBA 816 touching the battery 808 and shorting and/or may prevent against damage from impacts. Additionally, the midframe 812 may include a receptacle for the NFMI coil 814. As also discussed herein, the PCBA 816 may, in some instances, include a first PCB and a second PCB disposed on opposite sides of the battery 808 (or opposing sides of the midframe 812). The first PCB and the second PCB may couple via a connector, rigid flex, or flex circuit.

The inner housing assembly 704 may include the inner housing 112, the charging module 114 (shown in exploded view in FIG. 8), the IR sensor 116 (shown in exploded view in FIG. 8), the eartip 118, a BA driver 818, a loudspeaker boot 820, and/or loudspeaker mesh 822. As discussed herein, the BA driver 818 (i.e., loudspeaker) and the loudspeaker boot 820 may reside within the neck 300 of the inner housing 112. The loudspeaker mesh 822 may reside over the opening 600 at the second end 108 of the wireless earbud 100 to prevent the moisture reaching components of the wireless earbud 100, such as the PCBA 816, while allowing sound generated by the BA driver 818 to pass therethrough.

Figure 9B:
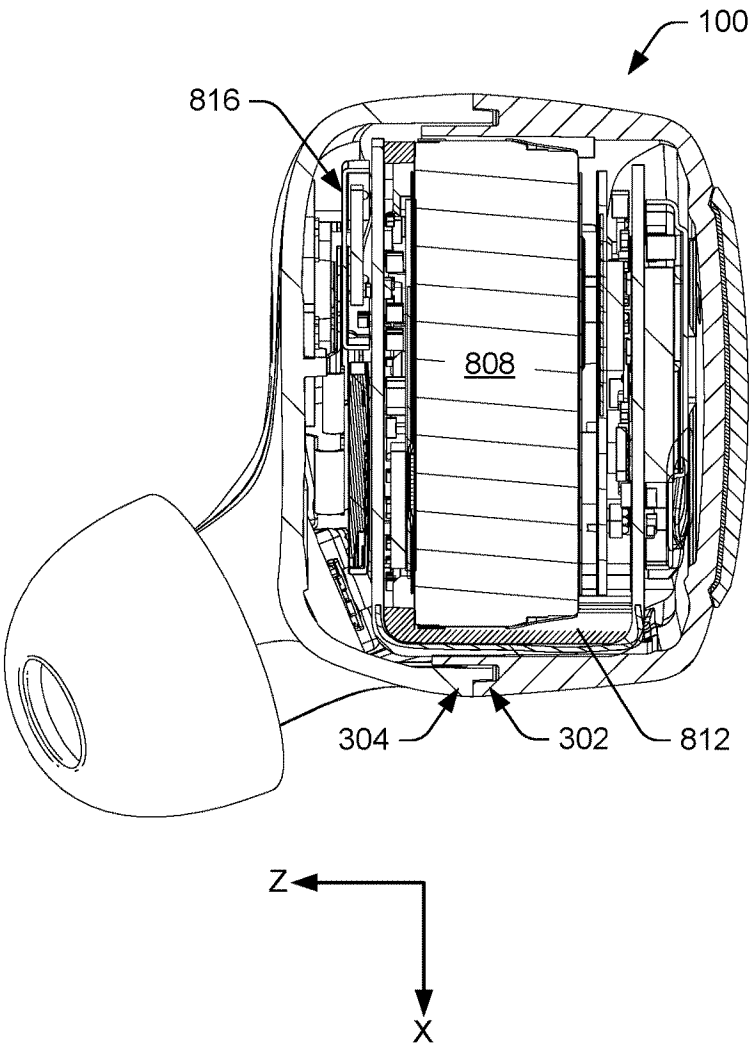
FIG. 9B illustrates a second cross-sectional view of the earbud of FIG. 1, taken along the line B-B of FIG. 6, according to an embodiment of the present disclosure.
Figure 9A:
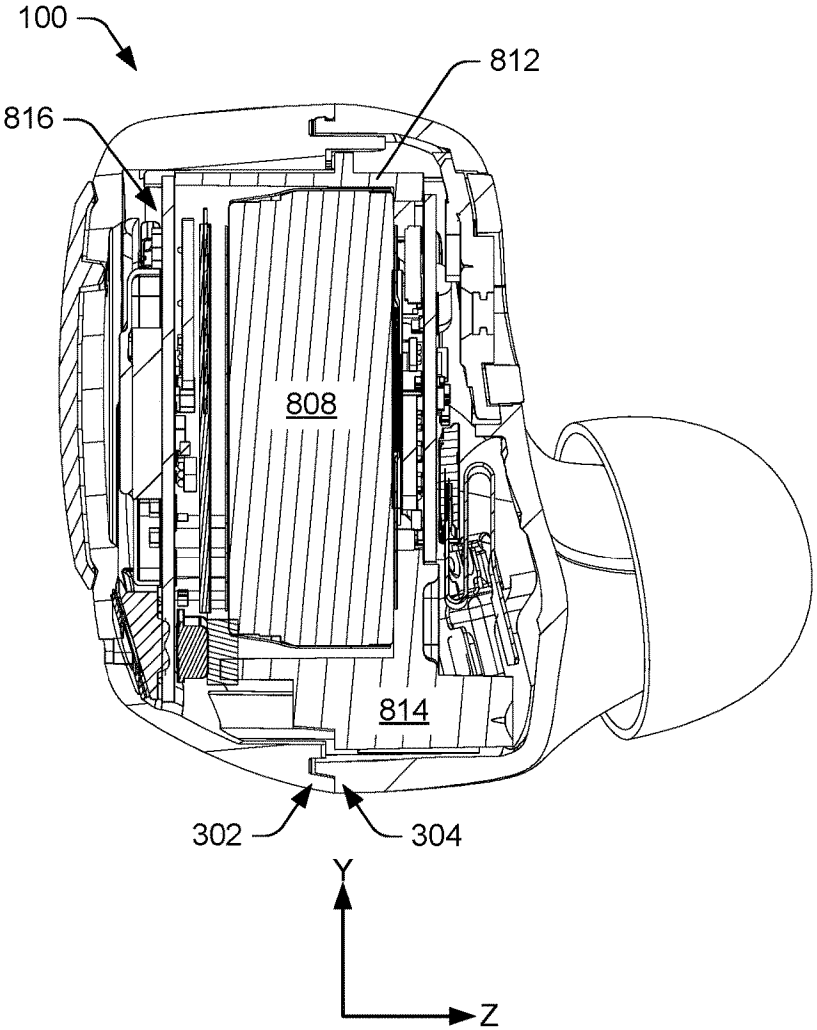
FIG. 9A illustrates a first cross-sectional view of the earbud of FIG. 1, taken along the line A-A of FIG. 5, according to an embodiment of the present disclosure.

FIGS. 9A and 9B illustrate cross-sectional views of the wireless earbud 100. More particularly, FIG. 9A illustrates a cross-sectional view taken along line A-A of FIG. 5, while FIG. 9B illustrates a cross-sectional view taken along line B-B of FIG. 6. As shown, components of the wireless earbud 100 reside within an interior of the wireless earbud 100 when assembled. In some instances, the components may couple to the midframe 812. For example, the battery 808 may couple to or reside within the midframe 812. Additionally, FIGS. 9A and 9B illustrate that a first PCB of the PCBA 816 may reside on a first side of the midframe 812, and that a second PCB of the PCBA 816 may reside on a second side of the PCBA 816. In such instances, the battery 808 may be interposed between the first PCB and the second PCB. Moreover, the NFMI coil 814 may reside within the midframe 812. In some instances, the NFMI coil 814 may be oriented perpendicularly to the first PCB or the second PCB of the PCBA 816

FIGS. 9A and 9B illustrate an additional example of the first attachment mechanism 302 engaging with the second attachment mechanism 304.

Figure 10:
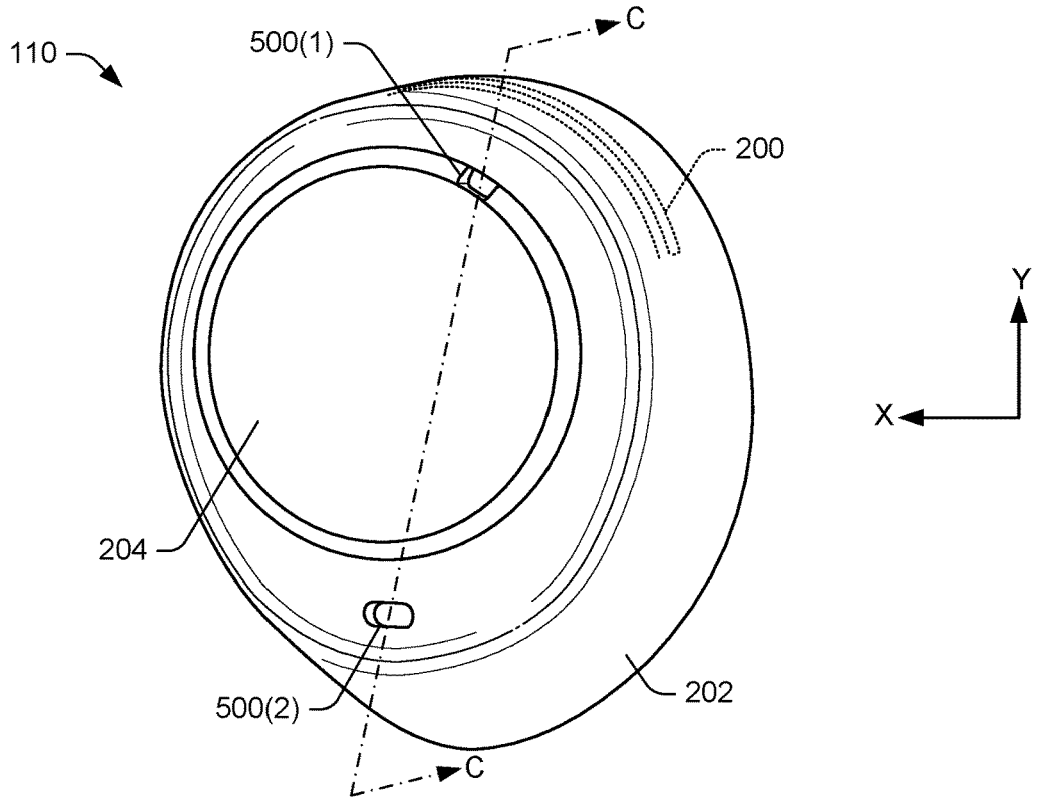
FIG. 10 illustrates a first perspective view of an example outer housing of the earbud of FIG. 1, according to an embodiment of the present disclosure.

FIG. 10 illustrates a first side view of the outer housing 110. The outer housing 110 may include the exterior surface 202, which may form a portion of the exterior surface 104 of the wireless earbud 100 when assembled. The antenna 200 is shown disposed on the exterior surface 202 of the outer housing 110, which in some instances, may be formed directly onto the exterior surface 202 using LDS. In some instances, the antenna 200 may not be visible or otherwise noticeable, but instead, may be concealed or covered by a surface treatment of the wireless earbud 100 (e.g., paint).

Additionally, as shown in FIG. 10, the outer housing 110 may include the microphone port(s) 500. Further, although FIG. 10 illustrates a particular arrangement or location of the microphone port(s) 500, in some instances, the microphone port(s) 500 may be located elsewhere on the outer housing 110 (or the wireless earbud 100).

Figure 11:
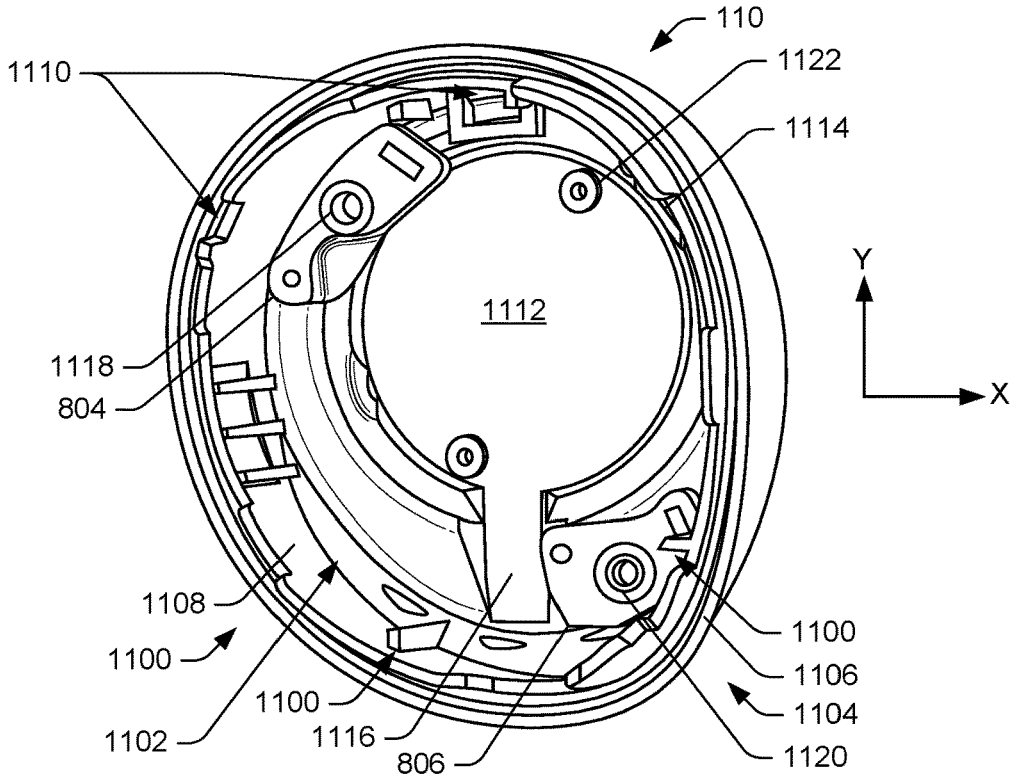
FIG. 11 illustrates a second perspective view of the outer housing of FIG. 10, according to an embodiment of the present disclosure.

FIG. 11 illustrates a second side view of the outer housing 110, showing an interior 1100 of the outer housing 110. The interior 1100 may include a cavity 1102 sized and configured to receive the midframe 812. That is, when the wireless earbud 100 is assembled, the midframe 812, or at least a portion of the midframe 812, may reside within the cavity 1102. The outer housing 110 may include an opening 1104 that provides access to the interior 1100 and/or the cavity 1102. The opening 1104 may include an annulus 1106. In some instances, the annulus 1106 may include the first attachment mechanism 302 for coupling the outer housing 110 and the inner housing 112. Additionally, or alternatively, the first attachment mechanism 302 may be disposed proximate to the annulus 1106. In some instances, the first attachment mechanism 302 may extend around a circumference or perimeter of the annulus 1106.

In some instances, the cavity 1102, or sidewalls 1108 of the outer housing 110 may include alignment elements 1110 that align the midframe 812 within the cavity 1102 and/or that align the inner housing 112 with the outer housing 110 and/or the midframe 812. As discussed herein, the alignment elements 1110 may engage with corresponding elements on the midframe 812 to align the midframe 812 within the outer housing 110. Additionally, the alignment elements 1110 may coordinate positioning of the outer housing 110 and the inner housing 112.

Additionally, or alternatively, in some instances, the alignment elements 1110 may align components of the wireless earbud 100 within one another. For example, the alignment elements 1110 may engage with alignment elements on the midframe 812 to align microphone(s) of the wireless earbud 100 with the microphone port(s) 500. In some instances, the alignment elements 1110 may also secure the midframe 812 within the outer housing 110, preventing the midframe 812 from repositioning or shifting (e.g., rotating). Accordingly, the alignment elements 1110 may align the outer housing 110, the inner housing 112, the midframe 812, and/or other components of the wireless earbud 100. As shown in FIG. 10, in some instances, the alignment elements 1110 may include struts, openings, slots, holes, extrusions, protrusions braces, flanges, ribs, and/or any combination thereof.

The outer housing 110, may include a proximity sensor 1112 configured to sense or otherwise detect a proximity from the user, such as a finger of the user, (e.g., capacitive sensor) at the first end 106 of the wireless earbud 100. In some instances, users may tap or double tap the on the exterior surface 104 adjacent to the proximity sensor 1112, such as the disc 204, and the proximity sensor 1112 may detect a corresponding input (e.g., change in capacitance value). In some instances, the user may interact with the proximity sensor 1112 to request various actions, such as to play music, pause music, answer phone calls, cancel phone calls, and so forth. In this sense, the user may utilize the proximity sensor 1112 for controlling the wireless earbud 100.

In some instances, the proximity sensor 1112 may be directly integrated or printed on the interior 1100 of the wireless earbud 100 using LDS. For example, after the outer housing 110 is produced (e.g., injection molding), a laser may scribe or etch a pattern associated with the proximity sensor 1112 onto the interior 1100 of the outer housing 110. Those areas of the outer housing 110 that are etched, or structured using the laser, may be plated with a conductive material (e.g., metal) to form a circuit trace, which may detect and sense a proximity of the user's fingers, for instance.

The antenna 200 may include a contact pad 1114 that couples to the PCBA 816 when the wireless earbud 100 is assembled. Similarly, the proximity sensor 1112 may include a contact pad 1116 that couples to the PCBA 816 when the wireless earbud 100 is assembled. In some instances, as the antenna 200 is formed on the exterior surface 104, the outer housing 110 may include an opening to accommodate the contact pad 1114, or through which the contact pad 1114 may protrude to couple to the PCBA 816.

In some instances, the outer housing 110 may also include holes for locating the disc 204 to the outer housing 110. In some instances, the disc 204 may include one or more plug(s) 1122 that extend through the holes and into the interior 1100. The plug(s) 1122 may engage with the interior 1100 to couple the disc 204 to the outer housing 110. In some instances, the disc 204 may reduce shock or static electricity entering the interior 1100 of the outer housing 110, or the wireless earbud 100. For example, as the user may touch the disc 204 to cause certain actions to be performed (e.g., playing music), in some instances, the disc 204 may serve as an electrostatic discharge to prevent static being transferred to components of the wireless earbud 100 and/or transferred into an interior of the wireless earbud 100. Additionally, or alternatively, the wireless earbud 100 or the outer housing 110 may include other features to discharge static electricity of the user. For example, the interior 1100 may include metal plating and/or other conductors. In some instances, the conductors may be directly integrated or printed onto the interior 1100 using LDS. Additionally, in some instances, the conductors may be disposed around one or both of the microphone port(s) 500 for dissipating static electricity.

As shown in FIG. 11, the first microphone boot 804 and the second microphone boot 806 may couple to the interior 1100 of the outer housing 110, adjacent to the microphone port(s) 500. The first microphone boot 804 may include a hole 1118 and the second microphone boot 806 may include a hole 1120 through which sound may pass to reach the microphone(s) on the PCBA 816. The hole 1118 of the first microphone boot 804 and the hole 1120 of the second microphone boot 806 may correspondingly align one of the microphone port(s) 500. Additionally, in some instances, the first microphone boot 804 and/or the second microphone boot 806 may include alignment features (e.g., tabs, holes, flanges, receptacle, etc.) that engage with corresponding alignment features (e.g., tabs, holes, flanges, receptacle, etc.) on the outer housing 110 to position or locate the first microphone boot 804 and/or the second microphone boot 806 within the outer housing 110.

While the antenna 200 and the proximity sensor 1112 are shown and discussed as being disposed on the exterior surface 202 and the interior 1100 of the outer housing 110, in some instances, the antenna 200 and/or the proximity sensor 1112 may be located elsewhere. For example, the wireless earbud 100 may include an antenna located within the interior 1100 of the outer housing 110 and/or an antenna may be included on a PCB or on a statistical process control (SPC). Moreover, the proximity sensor 1112 may be located on the exterior surface 202 of the outer housing 110.

Figure 12:
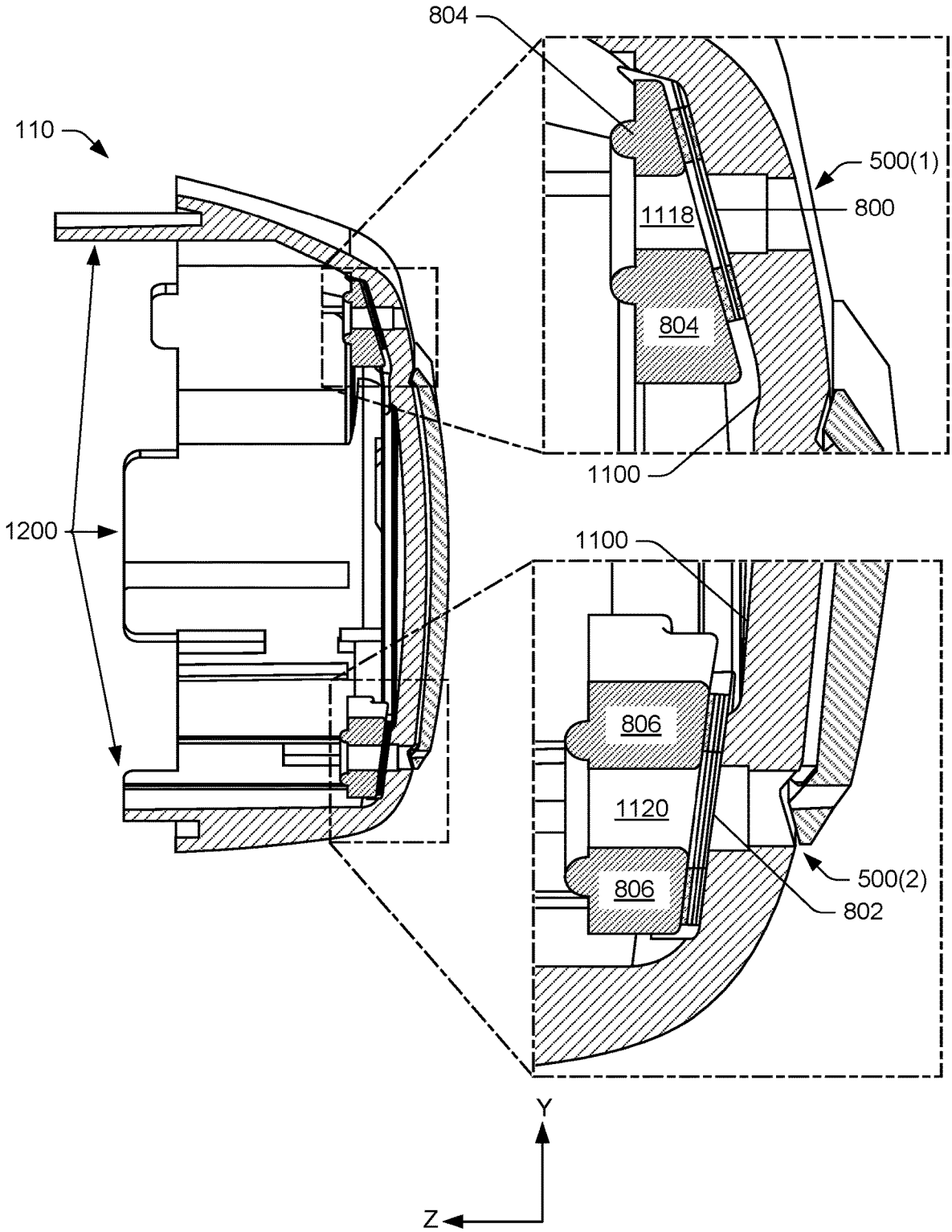
FIG. 12 illustrates a cross-sectional view of the outer housing of FIG. 10, taken along line C-C of FIG. 10, according to an embodiment of the present disclosure.

FIG. 12 illustrates a cross-sectional view of the outer housing 110 taken along line C-C of FIG. 10. FIG. 12 also illustrates detailed views showing the first microphone boot 804 and the second microphone boot 806 coupled to the outer housing 110. As shown in the detailed views, the hole 1118 of the first microphone boot 804 and the hole 1120 of the second microphone boot 806 may align with a respective microphone port of the microphone port(s) 500 such that sound may be directed towards the microphones of the wireless earbud 100. Additionally, the detailed views further illustrate the first microphone mesh 800 and the second microphone mesh 802 interposed between the first microphone boot 804 and the interior 1100 of the inner housing 112, and the second microphone boot 806 and the interior 1100 of the inner housing 112, respectively. In some instances, the first microphone mesh 800 and the second microphone mesh 802 may prevent, or substantially prevent, liquids or other moisture from reaching the interior of the wireless earbud 100, while allowing sound external to the wireless earbud 100 to reach the microphone(s). For example, the first microphone mesh 800 and/or the second microphone mesh 802 may be made of metals, plastics, rubbers, synthetics, and/or a combination thereof that meet IP68 standards.

In some instances, the first microphone mesh 800 and/or the second microphone mesh 802 may be held in place or secured to the outer housing 110 using adhesives, tape (e.g., pressure sensitive adhesive (PSA)), and/or press fit. Additionally, in some instances, the microphone port(s) 500 may be encased with foam that acoustically seals the microphones.

In some instances, the outer housing 110 may include additional flanges, tabs, extrusions, or features 1200 that assist in coupling, adjoining, or situating the outer housing 110 and the inner housing 112 in relation to one another. The features 1200 may additionally or alternatively position components within the wireless earbud 100. For example, the features 1200 may partially encase sides of the midframe 812 to prevent the midframe 812 from shifting. The features 1200 may also provide structural rigidity to the wireless earbud 100 to prevent the wireless earbud 100 from separating if dropped, for instance. Further, the features 1200 may abut components of the inner housing 112, such as the BA driver 818, when the wireless earbud 100 is assembled. As shown in FIG. 12, the features 1200 may extend from the interior 1100, cavity 1102 and/or sidewalls 1108 of the outer housing 110.

Figure 13A:
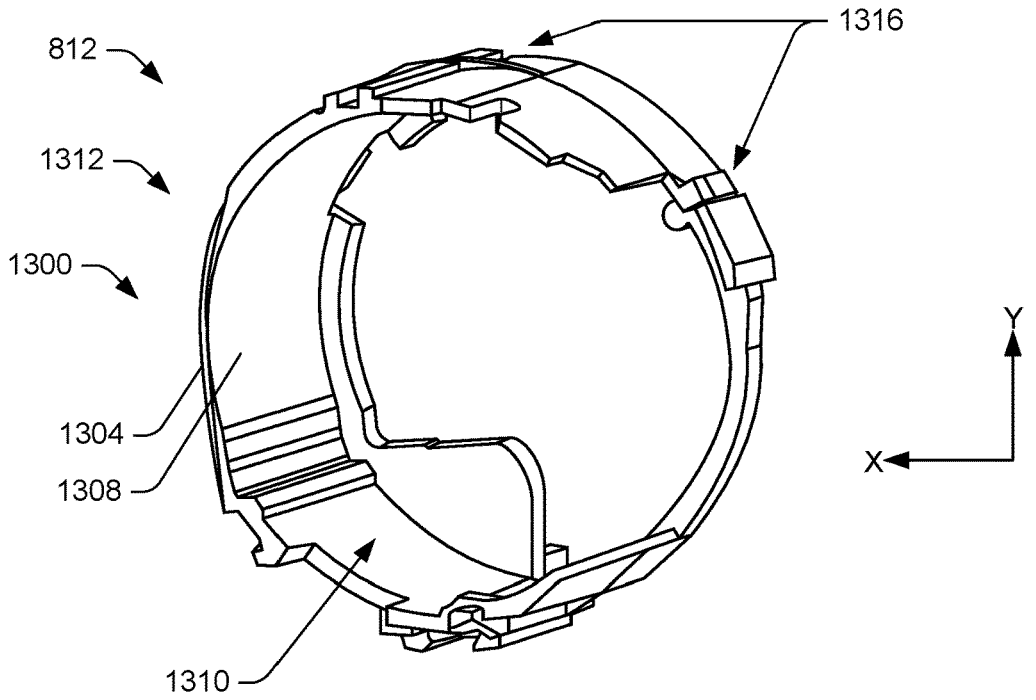
FIG. 13A illustrates a first perspective view of an example midframe of the earbud of FIG. 1, according to an embodiment of the present disclosure.
Figure 13B:
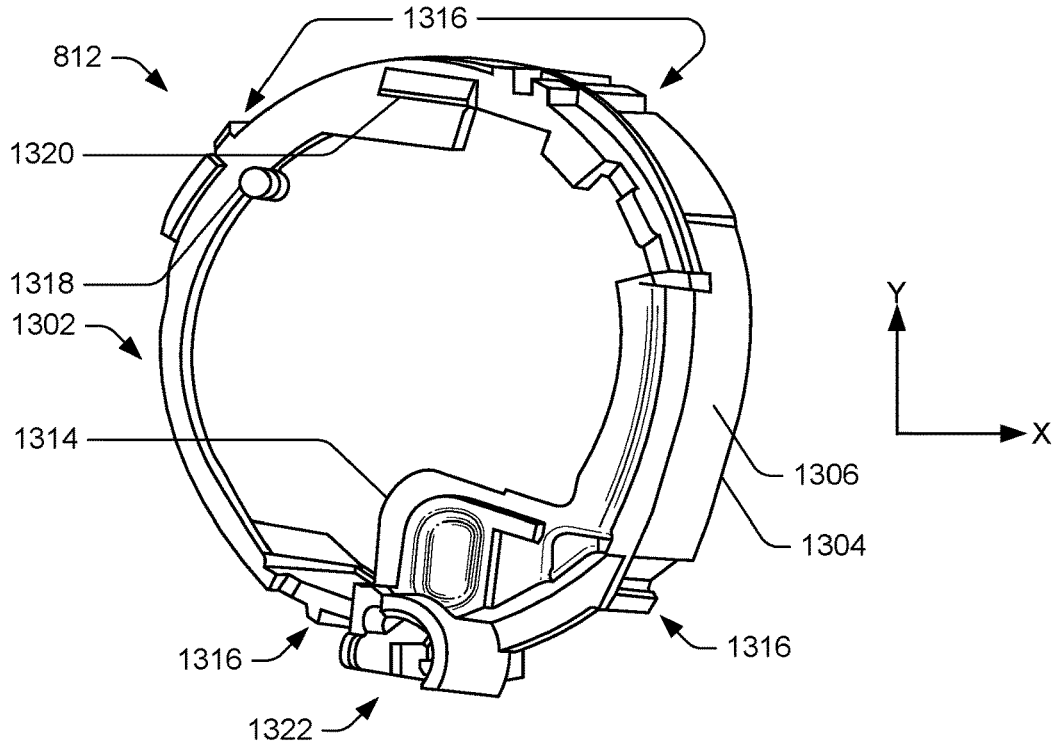
FIG. 13B illustrates a second perspective view of the midframe of FIG. 13A, according to an embodiment of the present disclosure.

FIGS. 13A and 13B illustrate perspective views of the midframe 812. In some instances, FIG. 13A may represent a rear perspective view of the midframe 812, while FIG. 13B may represent a front perspective view of the midframe 812. In some instances, the midframe 812 may include a first side 1300 and a second side 1302. A sidewall 1304 may extend between the first side 1300 and the second side 1302, and may include an exterior surface 1306 and an interior surface 1308. As shown in FIGS. 13A and 13B, the sidewall 1304 may include voids, cutouts, or holes, which in some instances, may allow the midframe 812 to reside or fit within the outer housing 110, the inner housing 112, or may create space to be occupied by components of the wireless earbud 100. In some instances, when the wireless earbud 100 is assembled, the first side 1300 may face, adjoin, or abut the outer housing 110, while the second side 1302 may face, adjoin, or abut the inner housing 112. Stated alternatively, in some instances, the first side 1300 may reside within the outer housing 110 and the second side 1302 may reside within the inner housing 112.

The midframe 812 may include a cavity 1310 within which the battery 808 may reside. The first side 1300 may include an opening 1312 to allow the insertion of the battery 808 into the midframe 812. Accordingly, the battery 808 may be placed within the midframe 812, through the first side 1300, to reside within the cavity 1310. In some instances, the battery 808 may be glued and/or taped within the midframe 812.

In some instances, the second side 1302 of the midframe 812 may include a shelf, lip, or flange 1314 for supporting the battery 808 once inserted into the midframe 812. In some instances, the flange 1314 may prevent the battery 808 from extending out of the second side 1302 (in the Z-direction). As shown in FIGS. 13A and 13B, in some instances, the flange 1314 may partially extend around a circumference or perimeter of the midframe 812 at the second side 1302. In some instances, the interior surface 1308 of the midframe 812 may include features that locate or position the battery 808 within the midframe 812. Accordingly, once the battery 808 is inserted into the midframe 812 the interior surface 1308 of the sidewall 1304 may wrap around or partially encase the battery 808.

As introduced above, the midframe 812 may reside at least partially within the outer housing 110 and/or the inner housing 112 *d*. To align the midframe 812 within the outer housing 110 and/or the inner housing 112, or to align the midframe 812 with the outer housing 110 and/or the inner housing 112, the midframe 812 may include alignment elements 1316. In some instances, the alignment elements 1316 may be included on the exterior surface 1306 and may engage with corresponding alignment elements on the outer housing 110 and/or the inner housing 112, respectively. For example, the alignment elements 1316 may engage with the alignment elements 1110 of the outer housing 110 to guide and/or position the midframe 812 within the outer housing 110. Additionally, or alternatively, the alignment elements 1316 may align the midframe 812 with the inner housing 112. In some instances, upon assembly, the midframe 812 may be rotated to engage the alignment elements 1316 with the alignment elements 1110. That is, rotating the midframe 812 may, in some instances, engage the alignment elements 1316 with the alignment elements 1110 to secure the midframe within the outer housing 110. Once engaged, the midframe 812 may fasten the midframe 812 (and the internal assembly 702), within the outer housing 110.

The midframe 812 may also include pins, flanges, protrusions, indentations, or other features that align other features of the internal assembly 702 within or with the midframe 812. For example, the second side 1302 of the midframe 812 may include features such as a pin 1318 that engages with an opening or hole on the PCBA 816 to locate the PCBA 816 on the midframe 812. Additionally, or alternatively, the features may include one or more ribs 1320 that engage with a perimeter or exterior of the PCBA 816 to locate the PCBA 816 on the midframe 812. The first side 1300 may additionally, or alternatively, include such features to assist in locating the PCBA 816.

The midframe 812 may also include a receptacle, holder, or slot 1322 for receiving the NFMI coil 814. As shown the slot 1322 may be cylindrical or substantially cylindrical in shape, and may extend from the second side 1302 of the midframe 812 towards the first side 1300 (Z-direction). In some instances, the NFMI coil 814 may slide into the slot 1322 (Z-direction), and may be partially encased or surrounded by sidewalls of the slot 1322. In some instances, the NFMI coil 814 may be secured to the midframe 812, or within the slot 1322, via glue or adhesive.

Figure 14A:
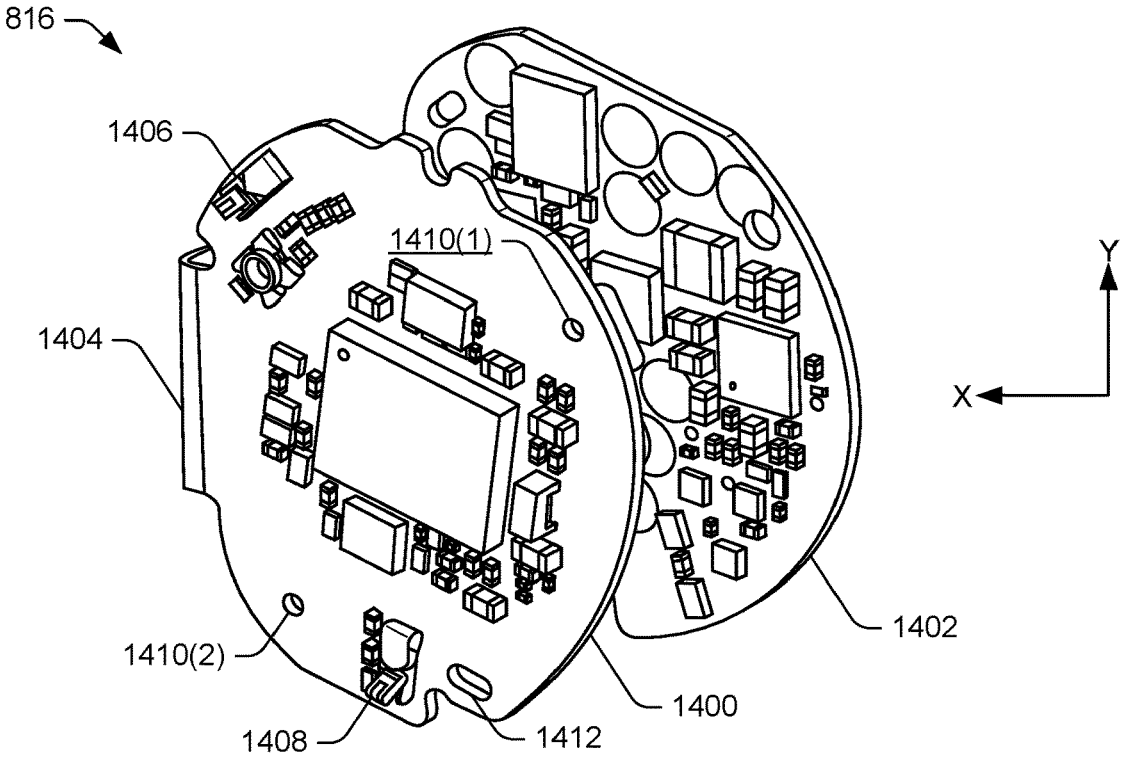
FIG. 14A illustrates a first perspective view of an example printed circuit board assembly of the earbud of FIG. 1, according to an embodiment of the present disclosure.
Figure 14B:
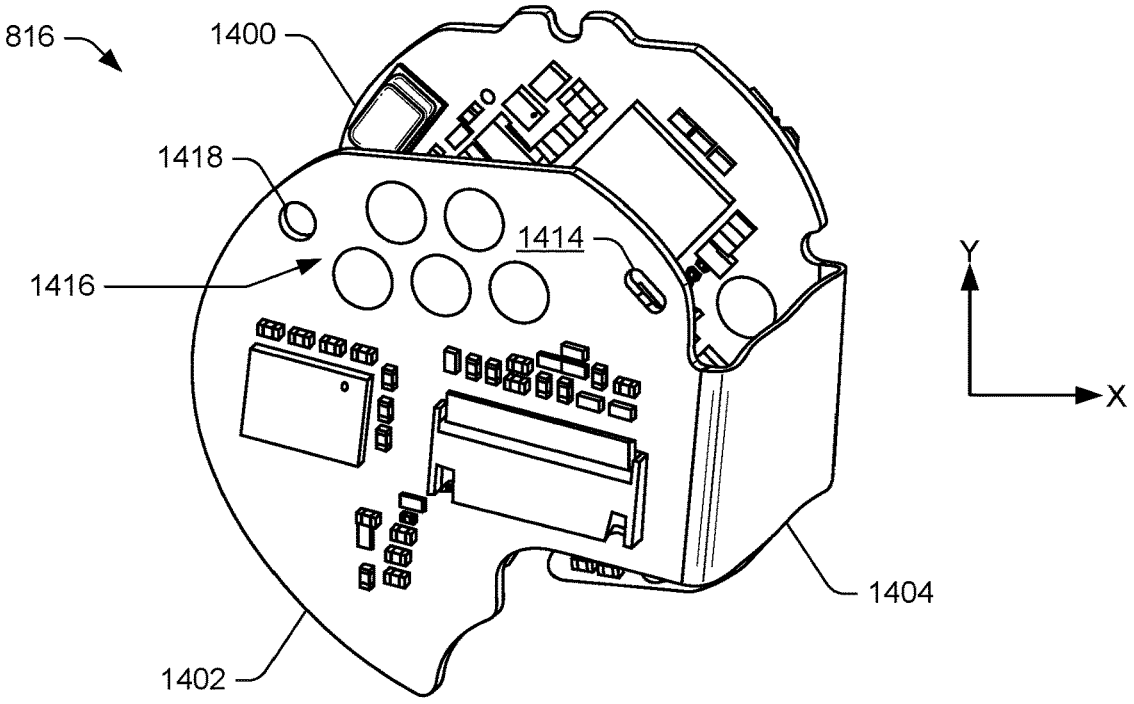
FIG. 14B illustrates a second perspective view of the printed circuit board assembly of FIG. 14A, according to an embodiment of the present disclosure.

FIGS. 14A and 14B illustrate perspective views of the PCBA 816. In some instances, the PCBA 816 may include a first PCB 1400 and a second PCB 1402. However, in some instances, the PCBA 816 may include more than or less than two PCBs (e.g., one, three, etc.). Additionally, or alternatively, the PCBs may be one-side or two-sided. In instances where the PCBA 816 includes more than one PCB, the PCBs may communicatively couple via a connector, rigid flex, or flex circuit. For example, the first PCB 1400 and the second PCB 1402 may couple via a connector 1404 (e.g., zero insertion force (ZIF) connector), which may link processing on the first PCB 1400 with processing on the second PCB 1402, vice versa. In addition, the connector 1404 may provide power to the first PCB 1400 and the second PCB 1402.

As introduced above and as will be discussed in FIGS. 15A and 15B, the PCBA 816 may couple to the midframe 812. In some instances, the first PCB 1400 may couple, abut, or be disposed adjacent to the first side 1300 of the midframe 812, while the second PCB 1402 may couple, abut, or be disposed adjacent to the second side 1302 of the midframe 812. As such, the first PCB 1400 may face or orient towards the outer housing 110, while the second PCB 1402 may face or orient towards the inner housing 112. Further, the connector 1404 may wrap or extend along the exterior surface 1306 of the midframe 812.

In some instances, the first PCB 1400 may include a first contact spring 1406 and a second contact spring 1408. The first contact spring 1406 may engage or contact the contact pad 1114 of the antenna 200 to communicatively couple the antenna 200 to network interface(s) on the PCBA 816, for example. The second contact spring 1408 may engage or contact the contact pad 1116 of the proximity sensor 1112 to provide signals generated by the proximity sensor 1112 to the PCBA 816.

The first PCB 1400 may also include a first microphone hole 1410(1) and a second microphone hole 1410(2) (collectively "the microphone holes 1410") disposed through the first PCB 1400. The microphone holes 1410 may align with a corresponding one of the microphone port(s) 500 of the outer housing 110. Microphone(s) located on an adjacent or underneath side of the first PCB 1400 may receive sound via the microphone holes 1410 and the microphone port(s) 500. As discussed above, to permit acoustic signals to reach the microphone(s), the microphone(s) may be aligned or disposed beneath microphone port(s) 500 extending through the outer housing 110, the first microphone boot 804, and the second microphone boot 806, respectively. In some instances, a foam substrate or other sound isolation substrate may acoustically insulate the microphone(s), the microphone port(s) 500, and/or the microphone holes 1410.

The first PCB 1400 may include an opening 1412 for connecting the first PCB 1400 to the battery 808. For example, once the first PCB 1400, or the PCBA 816, couples to the midframe 812 (which includes the battery 808), a tab, prong, or terminal of the battery 808 may extend through, or partially into, the opening 1412. Therein, the terminal and the first PCB 1400 may be soldered together. In some instances, the first PCB 1400 may receive a negative terminal of the battery 808.

The second PCB 1402 may include an opening 1414 for connecting the second PCB 1402 to the battery 808. For example, once the second PCB 1402, or the PCBA 816, couples to the midframe 812 (which includes the battery 808), a tab, prong, or terminal of the battery 808 may extend through, or partially into, the opening 1414. Therein, the terminal and the second PCB 1402 may be soldered together. In some instances, the second PCB 1402 may receive a positive terminal of the battery 808. However, although the first PCB 1400 is described coupling to the negative terminal and the second PCB 1402 is described coupling to the positive terminal, in some instances, the first PCB 1400 may couple to the positive terminal and the second PCB 1402 may couple to the negative terminal. Additionally, or alternatively, the first PCB 1400 may couple to both the negative and positive terminal, or the second PCB 1402 may couple to both the negative terminal and the positive terminal.

The second PCB 1402 may include contacts or pads 1416 for coupling to components of the charging module 114. When the wireless earbud 100 is assembled, pins of the charging module 114, for example, may engage or contact the pads 1416. As such, the pads 1416 may receive energy for charging the battery 808 when the charging module 114 is connected to the charger (or case). The second PCB 1402 may correspondingly include circuits, transformers, charging circuitry, etc. to charge the battery 808.

Shown in FIG. 14B, in some instances, the second PCB 1402 may include five pads 1416 arranged in rows, columns, or in a pattern corresponding to a pattern of the pins of the charging module 114. However, in some instances, the second PCB 1402 may include more than or less than five pads 1416 and/or the pads 1416 may be arranged differently as shown in FIG. 14B to accommodate different arrangements or designs of the charging module 114.

The second PCB 1402 may also include an opening 1418 for aligning or receiving features of the midframe 812, such as the pin 1318.

The first PCB 1400 and/or the second PCB 1402 may further include other computing components, such as processor(s), memory, codecs, systems on a chip (SOC), digital signal processing (DSP) components, flash components, circuits, transformers, etc. The first PCB 1400 and/or the second PCB 1402 may also include network interfaces and/or transceivers configured for communicating with other devices, such as mobile phones, tablets, computers, wireless earbuds (e.g., a paired wireless earbud), other portable audio input/output devices, and/or any other computing device capable of communication. For instance, the first PCB 1400 and/or the second PCB 1402 may include ZigBee interfaces, Bluetooth interfaces, BLE interfaces, NFMI interfaces, Wi-Fi interfaces, adaptive frequency technology (AFT) interfaces, or the like. Using the network interfaces, the wireless earbud 100 may communicatively couple to an electronic device, such as a mobile phone, via a first connection (e.g., Bluetooth). Additionally, the wireless earbud 100 may communicatively couple to an additional wireless earbud via a second connection (e.g., BLE) and/or third connection (NFMI). In some instances, the second connection between the wireless earbuds may be utilized for sending control data between the wireless earbuds (e.g., pause, increase volume, playback, etc.), while the third connection between the wireless earbuds may be utilized for transmitting audio data (e.g., music, podcasts, phone calls, etc.). In some instances, the first PCB 1400 may include a SOC, DSPs, and/or flash components, while the second PCB 1402 may include a NFMI interface and/or an audio codec. Additionally, although the first PCB 1400 and/or the second PCB 1402 are described as having certain components, the components may be located on different PCBs than discussed. Additionally, the first PCB 1400 and/or the second PCB 1402 may include additional components. For example, the first PCB 1400 and/or the second PCB 1402 may include light sensor(s), accelerometers, barometers, lighting elements (e.g. light emitting diodes (LEDs), navigation sensors (e.g., compass, global positioning satellite system, etc.), systems in package (SIP), etc. Additionally, given the compact nature of the wireless earbud 100, the first PCB 1400, the second PCB 1402, the midframe 812, the outer housing 110, and/or the inner housing 112 may include heat dissipating elements to dissipate heat generated by one or more components. For instance, the processor(s), and network interfaces of the first PCB 1400 and/or the second PCB 1402 may generate heat during use. To efficiently dissipate heat generated by the components, the heat dissipating elements may couple to the midframe 812 to transmit heat away from sources within the wireless earbud 100 toward an exterior of the wireless earbud 100 and/or to uniformly distribute the heat over the surface area of the wireless earbud 100 (e.g., exterior surface 104). Accordingly, the heat dissipating elements may prevent, or help prevent, the wireless earbud 100 overheating. Further, the wireless earbud 100, such as the midframe 812, may include graphite and/or ferrite plates, sheets, and/or tape to absorb radio frequencies or signals emitted by components of the wireless earbud 100 (e.g., network interfaces, codec, etc.)

As noted above, the first PCB 1400 and/or the second PCB 1402 may include memory. When present, the memory may store one or more software components, modules, or instructions that, when executed by one or more processors, configure the wireless earbud 100 to perform various operations. For instance, the wireless earbud 100 may be configured to capture and respond to user speech and to carry out speech processing, such as automatic speech recognition (ASR) or natural language understanding (NLU), speech synthesis may be performed by the components of the wireless earbud 100. By way of illustration, a user may verbally request the wireless earbud 100 (or another communicatively coupled computing device) to perform a particular task, such as to play music. The wireless earbud 100 may process the user command and cause one or more operations to be performed, such as playing the requested music over one or more loudspeakers of the wireless earbud 100. In some instances, to accomplish the operations performable by the wireless earbud 100, the components may be used in conjunction with network-based support services to support wireless data transfer.

By way of other examples, in some instances, the wireless earbud 100 may include a plurality of modules to implement various operations. For instance, the memory may include a user interface module that controls the operation of the proximity sensor 1112 for the user to interact with and control the wireless earbud 100. Additionally, in some instances, the memory may include a media player to begin playing content from one or more content sources stored in the memory. However, the memory may also include one or more other modules configured to perform a variety of other operations. Additionally, while the memory is described as including software functionality configured as one or more applications or "modules," the modules are intended to represent example divisions of the software for purposes of discussion, and are not intended to represent any type of requirement or required method, manner or necessary organization. Accordingly, while various "modules" are discussed, their functionality and/or similar functionality could be arranged differently (e.g., combined into a fewer number of modules, broken into a larger number of modules, etc.). For example, the wireless earbud 100 may additionally or alternatively include one or more hardware components (e.g., application specific integrated circuits, field programmable gate arrays, systems on a chip, and the like) to implement some or all of the functionalities the modules are described as performing.

The memory described herein is an example of non-transitory computer-readable media and may take the form of volatile memory, such as random access memory (RAM) and/or non-volatile memory, such as read only memory (ROM) or flash RAM. Non-transitory computer-readable media includes volatile and non-volatile, removable and non-removable media implemented in any method or technology for storage of information such as computer-readable instructions, data structures, program modules, or other data for execution by one or more processors of a computing device. Examples of non-transitory computer-readable media include, but are not limited to, phase change memory (PRAM), static random-access memory (SRAM), dynamic random-access memory (DRAM), other types of random access memory (RAM), read-only memory (ROM), electrically erasable programmable read-only memory (EEPROM), flash memory or other memory technology, compact disk read-only memory (CD-ROM), digital versatile disks (DVD) or other optical storage, magnetic cassettes, magnetic tape, magnetic disk storage or other magnetic storage devices, or any other non-transmission medium that can be used to store information for access by a computing device. As defined herein, computer-readable media does not include transitory media, such as modulated data signals and carrier waves.

Figure 15A:
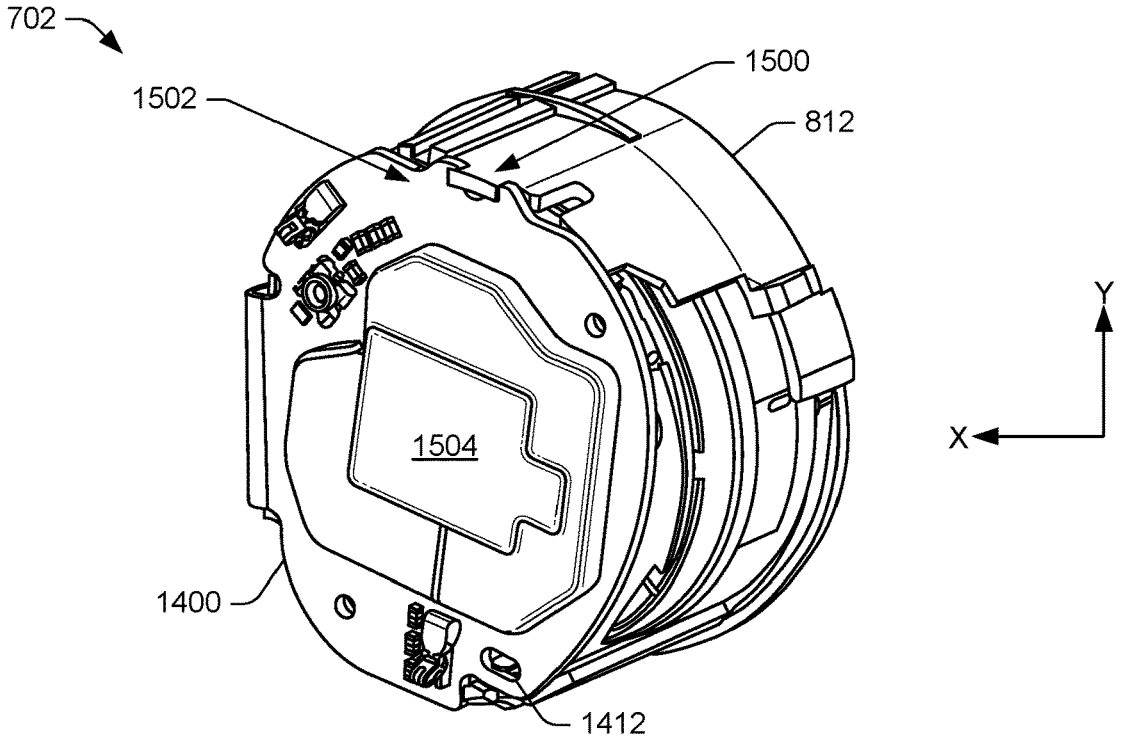
FIG. 15A illustrates a first perspective view of the printed circuit board assembly of FIG. 14A couple to the midframe of FIG. 13A, according to an embodiment of the present disclosure.
Figure 15B:
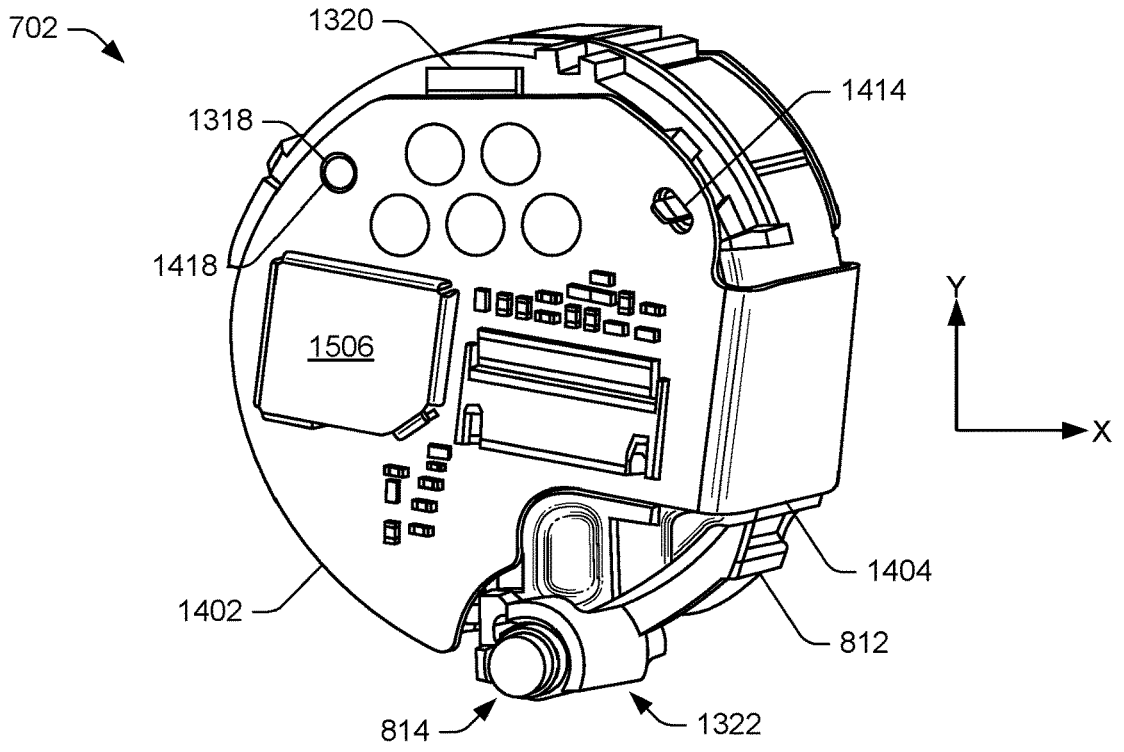
FIG. 15B illustrates a second perspective view of the printed circuit board assembly of FIG. 14A coupled to the midframe of FIG. 13A, according to an embodiment of the present disclosure.

FIGS. 15A and 15B illustrate perspective views of the internal assembly 702, showing the first PCB 1400 and the second PCB 1402 attached, adjoined, adhered, residing within, or otherwise coupled to the midframe 812. For example, FIG. 15A illustrates the battery 808 residing within the midframe 812, such as the cavity 1102. As shown in FIG. 15A, the first PCB 1400 is disposed adjacent to the first side 1300 of the midframe 812. As discussed above, the hole 1412 may accommodate a terminal (e.g., negative terminal) of the battery 808. Additionally, FIG. 15A illustrates that features of the first PCB 1400 may engage with corresponding features of the midframe 812 to align, position, or locate the first PCB 1400 on the midframe 812. For example, a tab 1500 of the midframe 812 may engage with a groove 1502 of the first PCB 1400.

As shown in FIG. 15B, the second PCB 1402 is disposed adjacent to the second side 1302 of the midframe 812. As discussed above, the opening 1412 may accommodate a terminal (e.g., positive terminal) of the battery 808. Additionally, FIG. 15A illustrates the pin 1318 of the midframe 812 being disposed through the opening 1418 of the second PCB 1402 to align, position, or locate the second PCB 1402. The ribs 1320 may also engage with an edge or surface of the second PCB 1402 to align, position, or locate the second PCB 1402.

FIG. 15B further illustrates the connector 1404 disposed over a portion of the exterior surface 1306 of the midframe 812 to couple the first PCB 1400 and the second PCB 1402. Additionally, as discussed above, the slot 1322 may receive or accommodate the NFMI coil 814. As shown, the NFMI coil 814 may reside within, or partially within, the slot 1322. In some instances, the NFMI coil 814 may be perpendicular, or substantially perpendicular, to the first PCB 1400 and/or the second PCB 1402. However, in some instances, the NFMI coil 814 may be oriented differently than shown. Further, in some instances, the NFMI coil 814 may be oriented towards an NFMI coil of a communicatively coupled device, such as an additional wireless earbud.

The NFMI coil 814 may include a ferrite coil that acts as an antenna for a NFMI interface. For example, the NFMI coil 814 may couple to an NFMI interface on the PCBA 816 through being soldered to one or both of the first PCB 1400 or the second PCB 1402. The NFMI coil 814 may receive signals from a corresponding NFMI coil and/or NFMI interface in another device, such as a second wireless earbud, such that NFMI may transmit data between wireless earbuds (e.g., audio data, voice data, etc.) In some instances, the NFMI coil 814 may be secured within the receptacle through a pressure fit, tape, glue, and/or adhesives.

The internal assembly 702 may also include the shielding cans or plates disposed over components of the PCBA 816. For example, as shown in FIG. 15A a first shielding can 1504 may be disposed over components of the first PCB 1400, such as a SOC, and as shown in FIG. 15B, a second shielding can 1506 may be disposed over components of the second PCB 1402, such as an NFMI interface. The first shielding can 1504 and the second shielding can 1506 may include shielding materials and/or isolating materials to guard against incoming or outgoing emissions of electromagnetic frequencies of the wireless earbud 100.

Additionally, interposed between the first PCB 1400 and the battery 808 may the first battery foam 810(1), that protects against impacts experienced by the wireless earbud 100, such as if the wireless earbud 100 is dropped, and/or prevents the first PCB 1400 from contacting the battery 808 and shorting. The second battery foam 810(2), may additionally, or alternatively be disposed between the second PCB 1402 and the battery 808. The battery foam 810 may therefore provide impact absorption to protect components of the wireless earbud 100 and/or prevent shorting.

Figure 16:
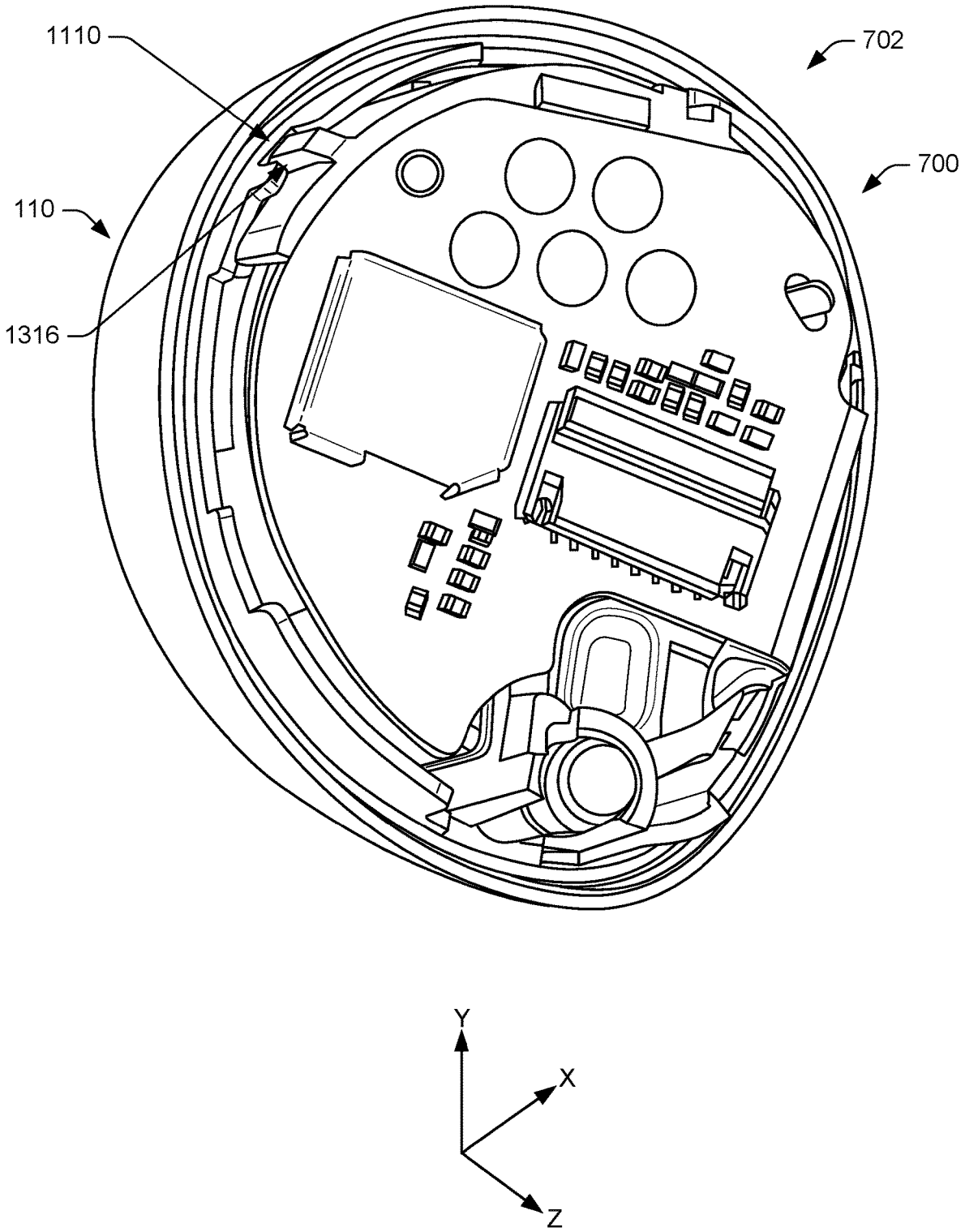
FIG. 16 illustrates a perspective view of example components disposed within the outer housing of FIG. 10, according to an embodiment of the present disclosure.

FIG. 16 illustrates a perspective view of the internal assembly 702 attached, adjoined, inserted within, or otherwise coupled to the outer housing 110 (or the outer housing assembly 700). The alignment elements 1110 of the outer housing 110 and the alignment elements 1316 of the midframe 812 may align or position the midframe 812 within the outer housing 110. In some instances, the midframe 812 may be rotated into position within the outer housing 110 such that the alignment elements 1110 and the alignment elements 1316 engage with one another. Once engaged, the midframe 812 may be positioned and secured with the outer housing 110. Such positioning may align the microphone(s) with the microphone port(s) 500 and/or align the pads 1416 with the charging module 114 once the inner housing 112 couples to the outer housing 110, for instance.

Additionally, although FIG. 16 illustrates just one example of the alignment elements 1110 and the alignment elements 1316 engaging, the other alignment elements 1110 may correspondingly engage with the alignment elements 1316.

Figure 17C:
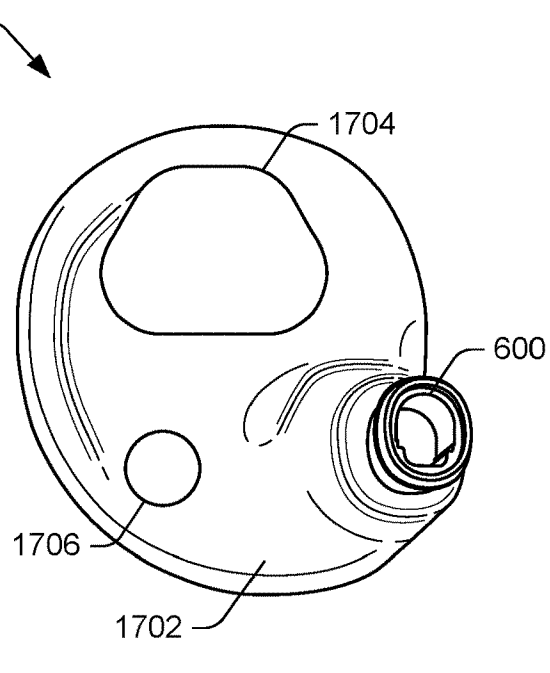
FIG. 17C illustrates a third side view of the inner housing of FIG. 17A, according to an embodiment of the present disclosure.
Figure 17B:
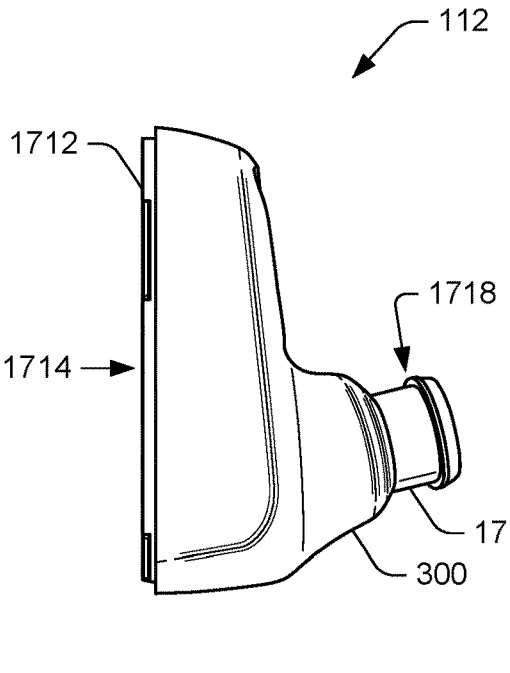
FIG. 17B illustrates a second side view of the inner housing of FIG. 17A, according to an embodiment of the present disclosure.
Figure 17A:
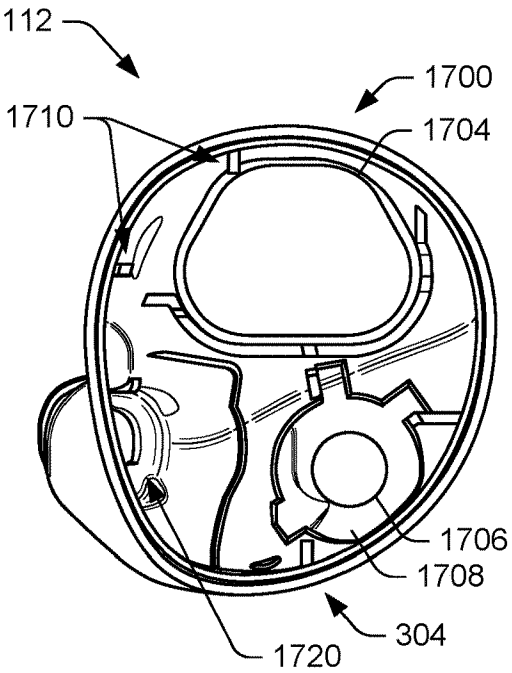
FIG. 17A illustrates a first side view of an example inner housing of the earbud of FIG. 1, according to an embodiment of the present disclosure.

FIGS. 17A, 17B, and 17C illustrate various views of the inner housing 112. More particularly, FIG. 17A illustrates a first side view of the inner housing 112, showing an interior 1700 of the inner housing 112, FIG. 17B illustrates a side view of the inner housing 112, and FIG. 17C illustrates a second side view of the inner housing 112, showing an exterior surface 1702 of the inner housing 112, which may form a portion of the exterior surface 104 of the wireless earbud 100. Additionally, the inner housing 112 may include the neck 300, having the opening 600 through which sound generated by loudspeaker(s) (e.g., BA device 818) of the wireless earbud 100 may exit.

The interior 1700 of the inner housing 112 receive components of the wireless earbud 100, such as the charging module 114, the IR sensor 116, the BA driver 818, and/or the loudspeaker boot 820. To receive components of the wireless earbud 100, the inner housing 112 may include one or more openings. For example, the inner housing 112 may include an opening 1704 sized and configured to receive the charging module 114. Additionally, the inner housing 112 may include an opening 1706 to accommodate the IR sensor 116 (e.g., for in-ear heart-rate monitoring, in-ear detection, etc.). In some instances, the opening 1706 may include a shape that corresponds to a shape of the IR sensor 116, vice versa. For example, the opening 1706 may be circular, as shown in FIGS. 17A and 17C, or may be rectangular, square, hexagonal, or a combination thereof.

In some instances, components of the wireless earbud 100 may couple to the interior 1700 of the wireless earbud 100, or to an interior surface of the inner housing 112. In some instances, to receive the components, the inner housing 112 may include notches, indentations, extrusions, flanges, recessions, or perturbances that align or position the components within the inner housing 112. For example, as shown in FIG. 17A the interior 1700 may include an aperture 1708 for receiving the IR sensor 116 (or a housing of the IR sensor 116).

As discussed above, to coordinate the positioning of the inner housing 112 with the outer housing 110 and/or the midframe 812, the inner housing 112 may include alignment elements 1710 (e.g., tabs, slots, extrusions, keyways, keys, etc.) that align with the alignment elements 1110 on the outer housing 110 and/or the alignment elements 1316 on the midframe 812, respectively. The respective alignment elements, for instance, may insure that the outer housing 110, the inner housing 112, and the midframe 812 seamlessly or compactly fit together to form the wireless earbud 100. Moreover, such alignment may insure that components of the wireless earbud 100 align, such as the pads 1416 on the second PCB 1402 with the charging module 114.

The inner housing 112 may also include the second attachment mechanism 304 to couple the inner housing 112 to the outer housing 110. In some instances, the second attachment mechanism 304 may be disposed around a least a portion of a perimeter, exterior, or periphery of the inner housing 112, such as an annulus 1712 of an opening 1714 that provides access to the interior 1700 of the inner housing 112. As discussed above, the engagement between the first attachment mechanism 302 and the second attachment mechanism 304 may enclose an interior of the wireless earbud 100.

The neck 300 may include features for receiving the eartip 118. For example, the neck 300 may include a recess 1716 for receiving a body of the eartip 118, and a lip 1718 that secures the eartip 118 to the neck 300. In some instances, the eartip 118 may be interchangeable depending on preferences of the user (e.g., size).

As shown in FIG. 17A, the neck 300 may include a pocket 1720 sized for receiving the BA driver 818 and/or the loudspeaker boot 820. For example, the BA driver 818 and/or the loudspeaker boot 820 may be placed within the pocket 1720 for directing sound towards the opening 600. In some instances, the pocket 1720 and/or the interior 1700 of the inner housing 112 may include features for aligning or BA driver 818 and/or securing the loudspeaker boot 820 within the pocket 1720 and/or the inner housing 112, respectively.

Figure 18:
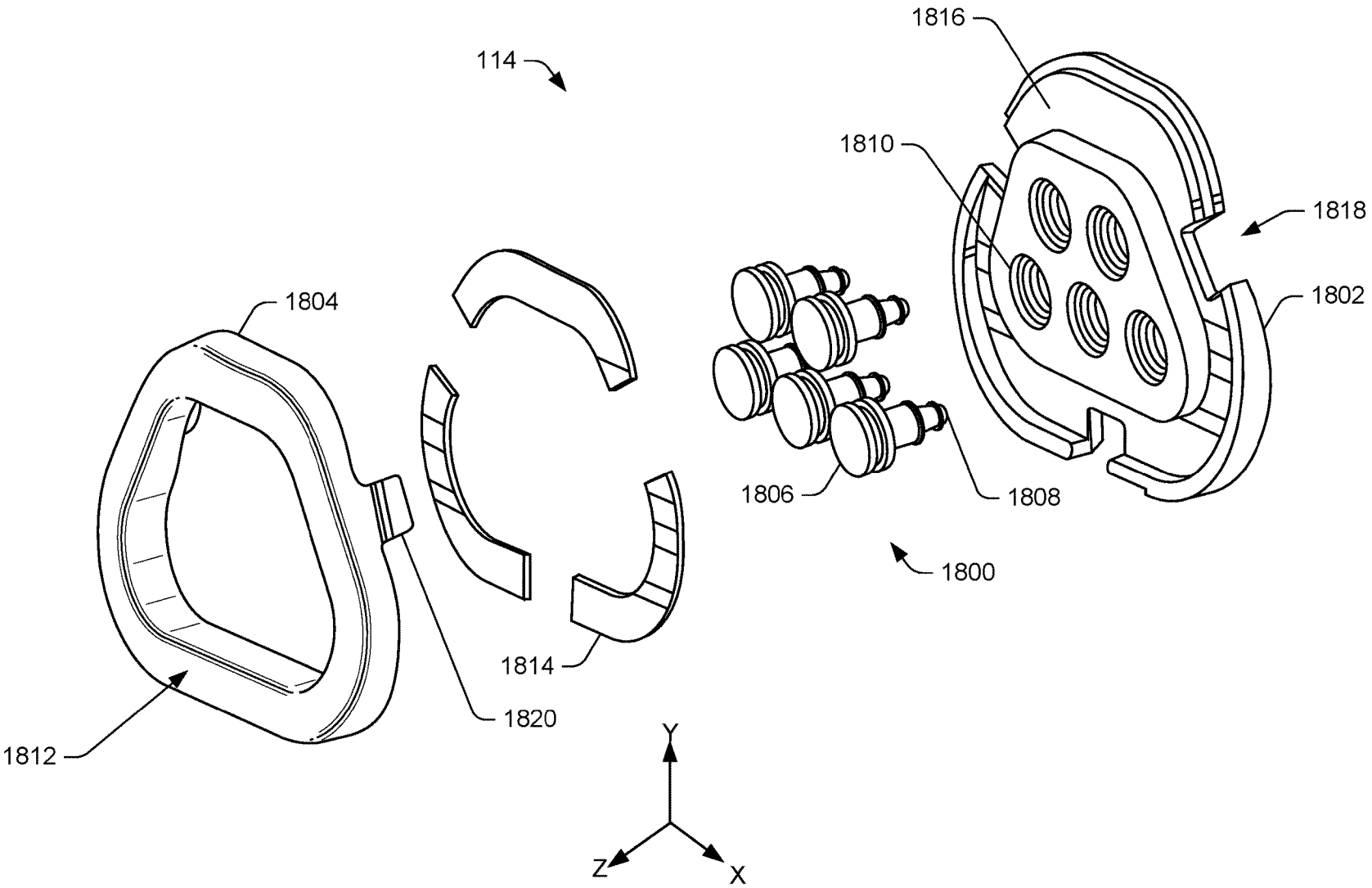
FIG. 18 illustrates an exploded view of an example charging module of the earbud of FIG. 1, according to an embodiment of the present disclosure.

FIG. 18 illustrates an exploded view of the charging module 114. In some instances, the charging module 114 may include pins 1800, a body 1802 (e.g., substrate, insulator pad, frame, support, etc.), and/or a seal 1804. The pins 1800 may include a conductive material (e.g., tin, bronze, gold-plated, nickel-free plating, etc.) that operably couple to the charger to transfer energy to components of the wireless earbud 100, such as the second PCB 1402 and the battery 808. In some instances, individual pins of the pins 1800 may include a first end 1806 and a second end 1808. In some instances, the first end 1806 may include a substantially planar surface for coupling or connecting the charger and the second end 1808, may in some instances, include pointed chamfered, or peaked tip for engaging with the pads 1416.

The body 1802 may include holes 1810 for accommodating the pins 1800. In some instances, the body 1802 may include an insulator material that does not readily conduct electricity such that the pins 1800 may transfer the energy to pads 1416. In some instances, the pins 1800 and the body 1802 may represent a single or integrated component when assembled. For example, the pins 1800 may be placed within a mold enclosure, and plastic may be injected into the mold enclosure. The body 1802 may be formed by injecting material into the mold enclosure such that the material fills and takes the form of the empty space between pins 1800 and the mold enclosure. The term mold enclosure, as used herein, describes a sealed enclosure that can be formed by a physical connection of two or more complementary parts. In some examples, the mold enclosure can be formed by two complementary mold tools.

The pins 1800 and the body 1802, as a single component, may be coupled or inserted within a receptacle 1812 of the seal 1804. The receptacle 1814 may therefore accommodate the body 1802 of the charging module 114. In some instances, the body 1802 and the seal 1804 may be secured using adhesives, pressure fits, tape, sonic welding, and/or other bonding techniques.

In some instances, the seal 1804 may include an embedded ring, metal, or magnetic element 1814. For example, the seal 1804 may be formed using a metal injection molding (MIM) process, whereby the magnetic element 1814 is placed within a mold enclosure. Thereafter, plastic may be injected into the mold enclosure such that the material fills and takes the form of the empty space between the magnetic element and the mold enclosure, forming the seal 1804.

In some instances, the magnetic element 1814 within the seal 1804 may engage or attract to a corresponding magnetic element on the charger or case. For example, the magnetic element 1814 within the seal 1804 may couple, situate, or adjoin the charging module 114 to the charger or case to secure the wireless earbud 100 while charging. Additionally, or alternatively, the wireless earbud 100 may include magnetic elements on, within, or inside the inner housing 112 for coupling to the charger and/or case.

The body 1802 may further include a trough or channel 1818 within which the seal 1804 resides when the charging module 114 is assembled. The seal 1804 may therefore be configured to reside within the channel 1816. Further, the body 1802 is shown including voids, or other indents 1818, through which tabs 1820 of the seal 1804 may extend. In some instances, the tabs 1820 may couple the seal 1804 to the outer housing 112, such as engaging with corresponding receptacles on the interior 1700 of the inner housing 112.

Figure 19A:
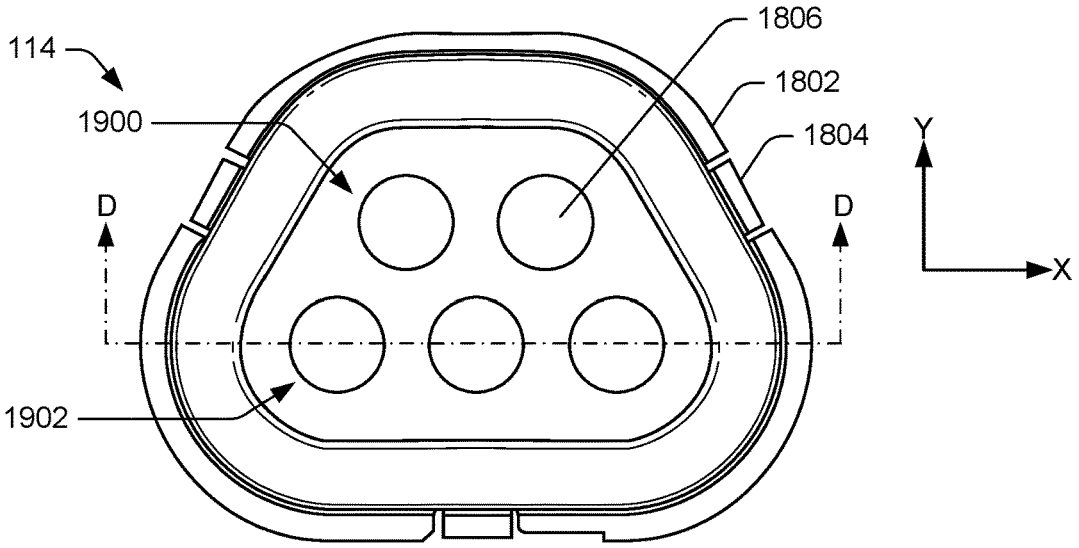
FIG. 19A illustrates a first side view of the charging module of FIG. 18, according to an embodiment of the present disclosure.
Figure 19B:
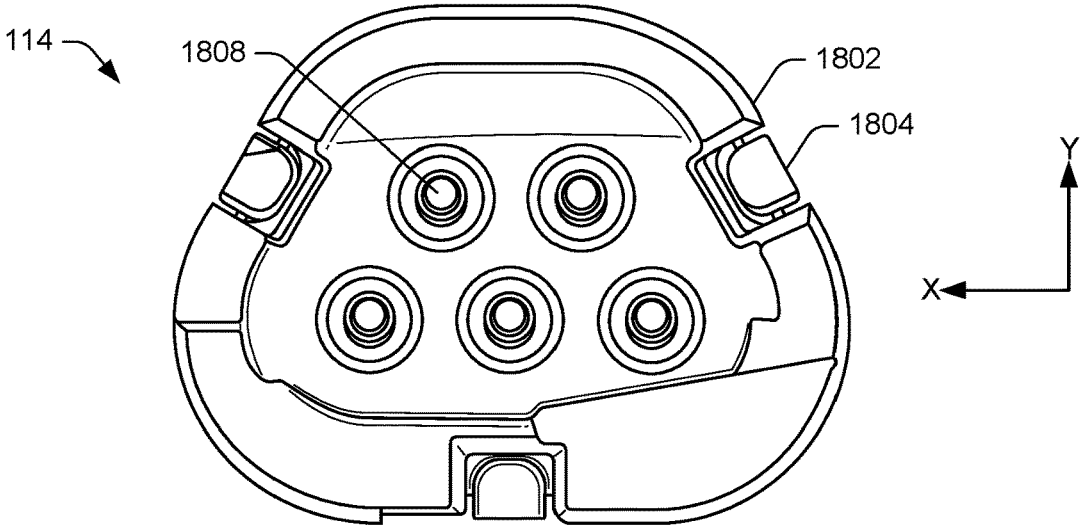
FIG. 19B illustrates a second side view of the charging module of FIG. 18, according to an embodiment of the present disclosure.
Figure 19C:
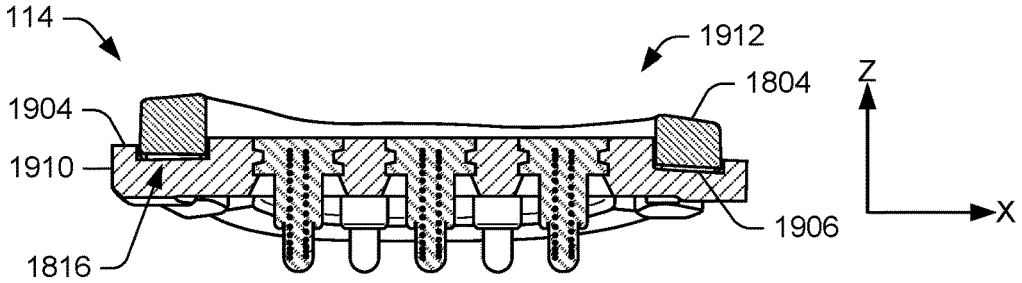
FIG. 19C illustrates a cross-sectional view of the charging module of FIG. 18, taken along line D-D of FIG. 19A, according to an embodiment of the present disclosure.

FIGS. 19A, 19B, and 19C illustrate various views of the charging module 114. More particularly, FIG. 19A illustrates an exterior of the charging module 114, FIG. 19B illustrates an interior of the charging module 114, and FIG. 19C illustrates a cross-sectional view of the charging module 114, taken along line D-D of FIG. 19A. In some instances, FIGS. 19A, 19B, and 19C may illustrate an assembled charging module 114 before being inserted into the opening 1704 and/or coupled to the inner housing 112.

In some instances, the charging module 114 may include five pins 1800. In some instances, a first pin may correspond to a transmitter pin, a second pin may correspond to a receiver pin, a third pin may correspond to a power pin, a fourth pin may correspond to a ground pin, and a fifth pin may correspond to an indicator pin for determining when (or if) the charging module 114 is connected to the charger and/or case. In other words, the fifth pin may be utilized to initiate charging of the wireless earbud 100 when a detector detects that the wireless earbud 100 is coupled to the charger and/or case.

In some instances, the pins 1800 of the charging module 114 may be arranged in one or more rows. For example, the charging module 114 may include a first row 1900 of pins 1800 and a second row 1902 of pins 1800 spaced apart in the Y-direction from the first row 1900. In some instances, the first row 1900 may include a first number of pins 1800 and the second row 1902 may include a second number of pins 1800. For example, the first row 1900 may include two pins 1800 and the second row 1902 may include three pins 1800. Additionally, in some instances, the pins 1800 may be equidistantly horizontally spaced apart (e.g., X-direction). Further, although the pins 1800 are shown in a particular arrangement (e.g., rows) or that the first row 1900 and the second row 1902 include a particular number of pins 1800, the charging module 114 may include a different number of pins 1800 and/or a different configuration than shown. For example, the charging module 114 may include two pins, where a first pin corresponds to a power pin and a second pin corresponds to a ground pin.

As noted above, FIG. 19A may illustrate an exterior of the charging module 114 that is disposed on an exterior of the wireless earbud 100. FIG. 19B may illustrate an interior of the charging module 114 that is disposed within the interior of the wireless earbud 100. That is, the first ends 1806 of the pins 1800 may engage with components of the charger, while the second ends 1808 of the pins 1800 may engage with the pads 1416 of the second PCB 1402 within the interior of the wireless earbud 100.

The body 1802 and/or the seal 1804 may include features that provide a watertight seal to prevent water from reaching internal components of the wireless earbud 100. For example, the body 1802 may, in some instances, include a bezel 1904, the channel 1816, a flange 1908, and/or a sidewall 1910. As discussed above, the seal 1804 may reside within the channel 1816 of the body 1802. For example, as shown in FIG. 19C, the seal 1804 may reside between sidewalls of the channel 1816. In doing so, the seal 1804 may contact or engage the flange 1906 and provide a watertight seal. Additionally, the seal 1804 may engage with the sidewalls of the channel 1816 to provide the watertight seal. The bezel 1904 may therefore reside at least partially around an exterior profile of the seal 1804 when coupled to the body 1802.

In some instances, the bezel 1904 may engage with the interior 1700 (or interior surface) of the inner housing 112. In some instances, the bezel 1904 may reside within a receptacle on the interior 1700 of the inner housing 112 to situate and/or position the charging module 114 within the inner housing 112 and/or the opening 1704. For example, the interior 1700 of the inner housing 112 may include a groove in which the bezel 1904 rests.

Additionally, or alternatively, the sidewall 1910 may engage with an edge or rim on the interior 1700 (or extending from the interior 1700) to situate and/or position the charging module 114 within the inner housing 112 and/or the opening 1704. In some instances, once the charging module 114 couples to the inner housing 112, the body 1802 and the seal 1804 may provide a tortious path to prevent water reaching from reaching the internal components of the wireless earbud 100.

In some instances, when the body 1802 and the seal 1804 couple together, a recess, slot, window, or pocket 1912 may be formed for accepting or receiving components of the charger (or case). For example, an interior perimeter of the seal 1804 may include a flange or sidewall that position or locate the charger within the pocket to align with the pins 1800 and/or the charging module 114.

FIG. 19C further illustrates the pins 1800 disposed within the body 1802 and the body 1802 disposed within the seal 1804.

Figure 20A:
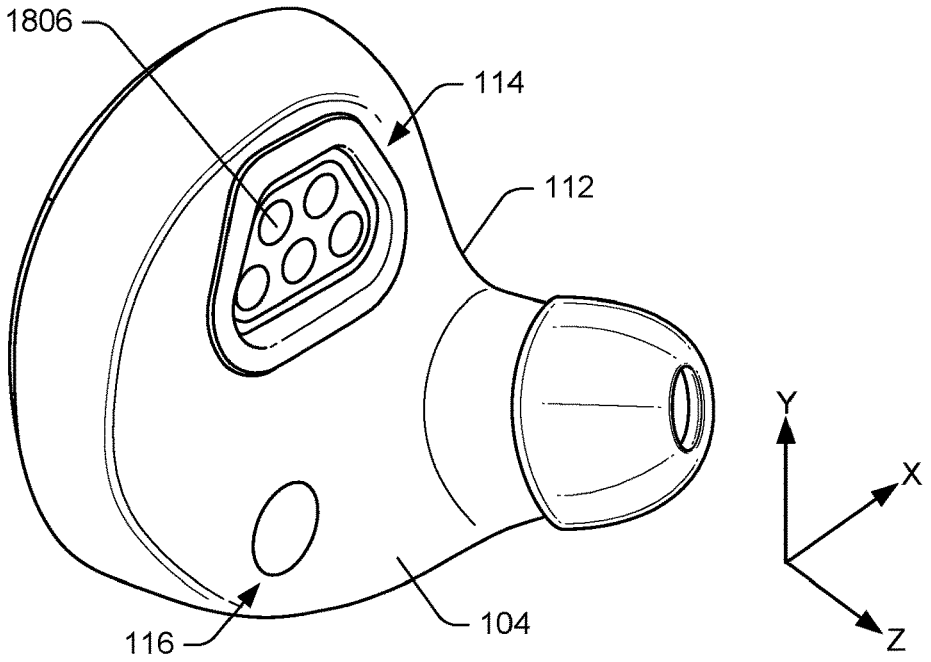
FIG. 20A illustrates a first perspective view of example components disposed within the inner housing of FIG. 17A, according to an embodiment of the present disclosure.
Figure 20B:
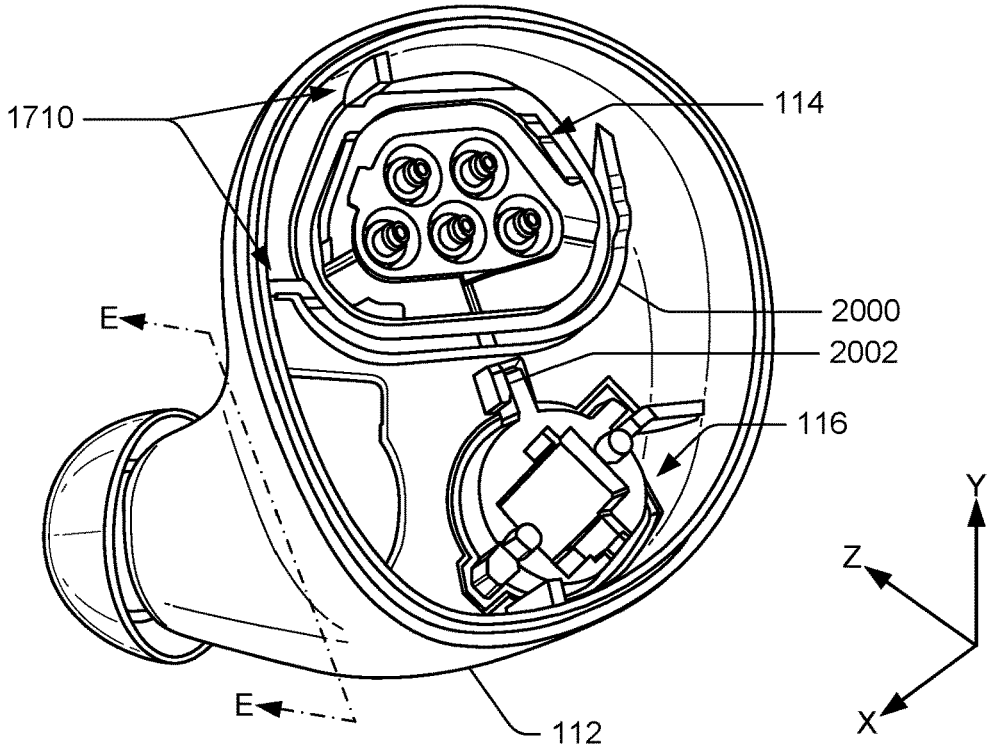
FIG. 20B illustrates a second perspective view of example components disposed within the inner housing of FIG. 17A, according to an embodiment of the present disclosure.

FIGS. 20A and 20B illustrate the charging module 114 and the IR sensor 116 coupled to the inner housing 112. More particularly, FIG. 20A illustrates an exterior view of the inner housing 112, while FIG. 20B illustrates an interior view of the inner housing 112. As shown, the charging module 114 may reside within the opening 1704 of the inner housing 112 and the first ends 1806 of the pins 1800 may outwardly face to engage with corresponding contacts of the charger and/or case. In some instances, the seal 1804 may be pressure fit within the opening 1704 to provide a water-tight seal. Additionally, as mentioned above, in some instances, the bezel 1904 or a portion thereof, be flush against the exterior surface 104 of the wireless earbud 100.

The IR sensor 116 may reside within the opening 1706 of the inner housing 112. In some instances, the IR sensor 116 may include an integrated receiver and transmitter. In some instances, a film or sheet of transparent material may be placed over the IR sensor 116. The IR sensor 116 may transmit light out of the opening 1706 (or through the transparent material) to detect whether the wireless earbud 100 is in proximity (e.g., threshold) to the ear of the user, or whether wireless earbud 100 is within the ear of the user for switching modes or powering certain components.

Turning to FIG. 20B, the interior 1700 of the inner housing 112 may include features that align or position the charging module 114 and/or the IR sensor 116. For example, the interior 1700 of the inner housing 112 may include a strut 2000 that aligns the charging module 114 within the inner housing 112. Similarly, in some instances, the inner housing 112 may include the receptacle 1708 for receiving the IR sensor 116. In some instances, the alignment elements 2002 may situate or align the IR sensor 116 within the inner housing 112. In some instances, the charging module 114 and/or the IR sensor 116 may further couple to the inner housing 112 via adhesives or tape.

As discussed above, the inner housing 112 may include the alignment elements 1710 that correspondingly engage or interact with the alignment elements 1710 on the outer housing 110 and/or the midframe 812, respectively.

Figure 21:
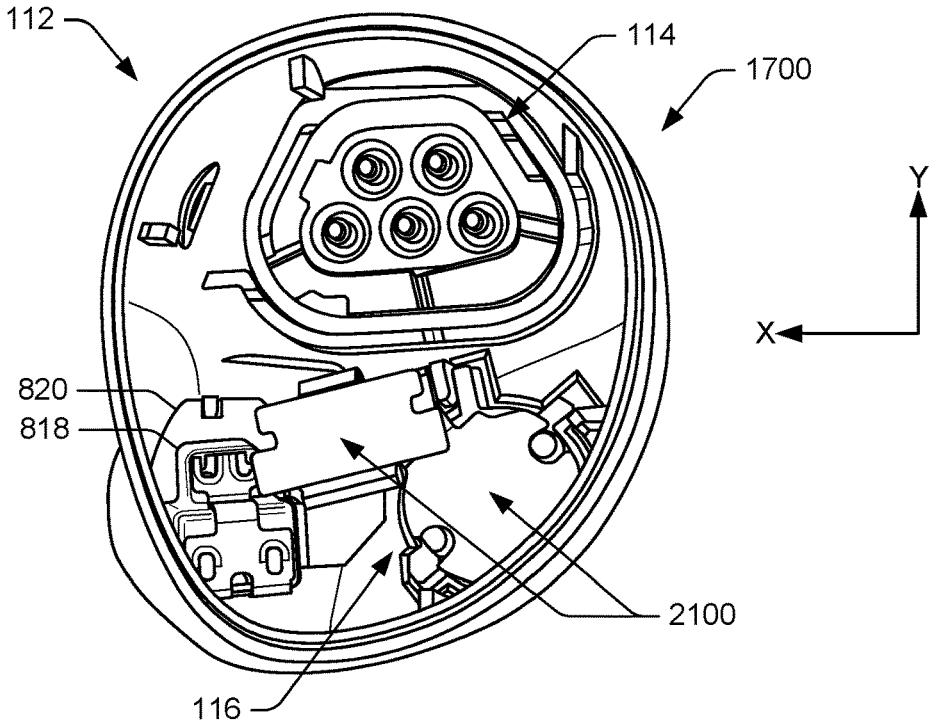
FIG. 21 illustrates a side view of example components disposed within the inner housing of FIG. 17A, according to an embodiment of the present disclosure.

FIG. 21 illustrates the interior 1700 of the inner housing 112, showing the charging module 114, the IR sensor 116, the BA driver 818, and the loudspeaker boot 820 disposed within the inner housing 112. The loudspeaker boot 820 may fit at least partially within the pocket 1720 of the neck 300. In some instances, the loudspeaker boot 820 may receive the BA driver 818. For example, the BA driver 818 is shown inserted within the neck 300 and oriented towards the opening 600.

FIG. 21 also illustrates one or more flex circuits 2100 that may communicatively couple the IR sensor 116 and/or the BA driver 818 to the PCBA 816. For example, the flex circuits 2100 may couple the IR sensor 116, the BA driver 818, and/or other components residing within the inner housing 112 to the second PCB 1402.

Figure 22:
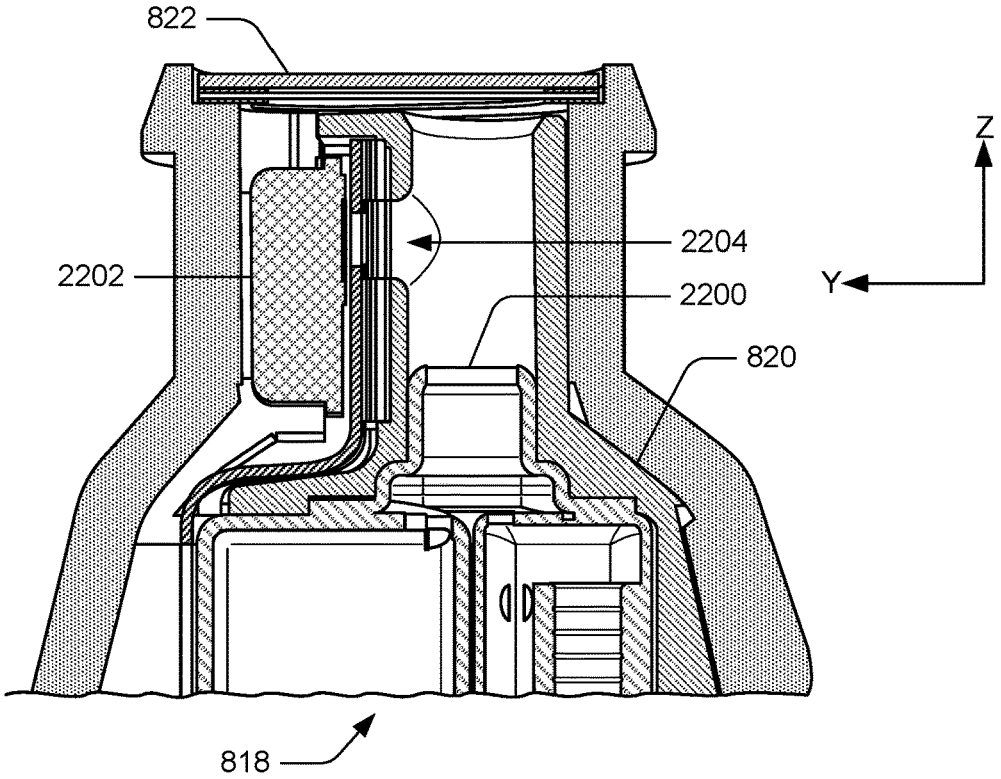
FIG. 22 illustrates a cross-sectional view of the inner housing of FIG. 17A taken along line E-E of FIG. 20B, showing example components disposed within the inner housing, according to an embodiment of the present disclosure.

FIG. 22 illustrates a cross-sectional view of the neck 300 of the inner housing 112, taken along line E-E of FIG. 20B, showing components of the wireless earbud 100 residing within the pocket 1720 of the neck 300. As shown, the loudspeaker boot 820 may reside within the neck 300 and engage with an interior surface of the inner housing 112. The loudspeaker boot 820 may include an opening 2200 for allowing sound output by the BA driver 818 to exit the wireless earbud 100. The BA driver 818 may at least partially reside within the loudspeaker boot 820, or may be disposed adjacent to the loudspeaker boot 820, to project sound towards the opening 600 and the opening 2200 of the loudspeaker boot 820.

In some instances, the wireless earbud 100 may include a microphone 2202 located within the neck 300 of the inner housing 112. The microphone 2202 may correspond to an in-ear microphone configured to receive sound generated by the user (from within the ear canal) for purpose of acoustic isolation. In some instances, the microphone 2202 may be oriented orthogonal or perpendicular to the opening 600.

To direct sound towards the microphone 2202, the loudspeaker boot 820 may include an orifice 2204 located adjacent to the opening 600. However, the microphone 2202 may be located elsewhere within the inner housing 112 and/or the wireless earbud 100. For example, the microphone 2202 may be located on the second PCB 1402. In some instances, the wireless earbud 100 may include ports, conduits, and/or passageways for channeling sound to the microphone 2202.

FIG. 22 further illustrates the loudspeaker mesh 822 disposed within or adjacent to the opening 600. The loudspeaker mesh 822 may permit sound to exit from within an interior of the wireless earbud 100 while preventing liquid permeating into the interior of the wireless earbud 100. In some instances, the loudspeaker mesh 822 may include an acoustic material, a metal material, a synthetic material, and/or a combination thereof having an IP68 rating. In instances, where the loudspeaker mesh 822 includes more than one layer, or material, the layers may be bonded or adjoined together using adhesives. Further, in some instances, the loudspeaker mesh 822 may be adhered to the inner housing 112, or within the opening 600, using adhesives, tape (e.g., PSA), and/or press-fit.

Figure 23:
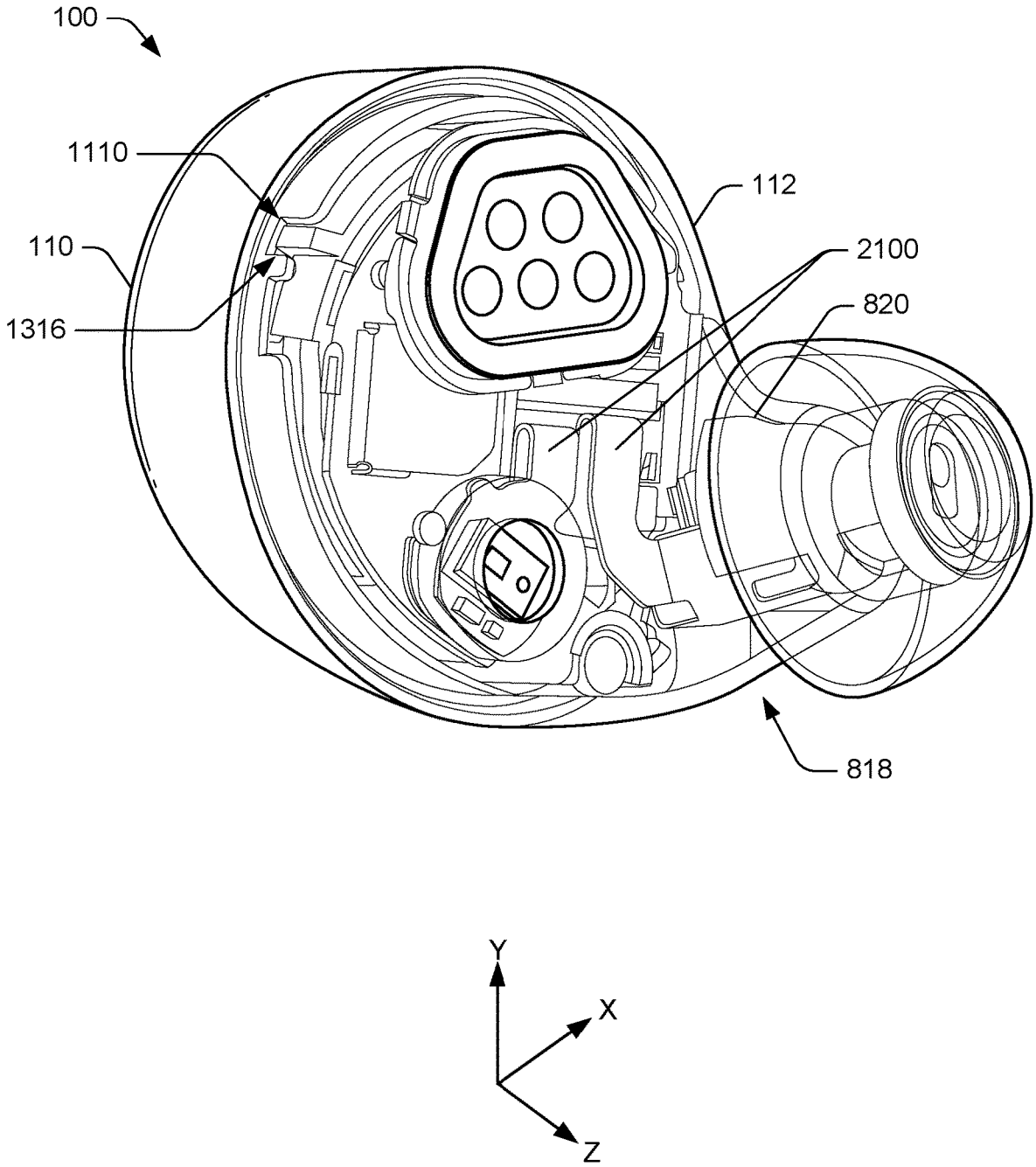
FIG. 23 illustrates a perspective view of the earbud of FIG. 1, showing the inner housing of FIG. 17A as transparent to illustrates example components of the earbud, according to an embodiment of the present disclosure.

FIG. 23 illustrates a perspective view of the wireless earbud 100, showing the inner housing 112 as translucent to illustrate components residing within the wireless earbud 100. FIG. 23 illustrates the outer housing 110 coupling to the inner housing 112 (e.g., via the first attachment mechanism 302 and the second attachment mechanism 304). As shown, alignment element 1110 of the outer housing 110 may receive alignment element 1316 of the midframe 812. In some instances, the midframe 812 may be rotated (e.g., counter clockwise about the Z-axis) to engage the alignment element 1110 (e.g., tab) within the alignment element 1316 (e.g., slot). Once engaged, the midframe 812 may be secured to the outer housing 110. The alignment elements 1316 may also engage the alignment elements 1710.

Additionally, the BA driver 818 and the loudspeaker boot 820 are shown disposed within the neck 300 (or the pocket 1720 of the neck 300) of the wireless earbud 100 to direct sound towards the opening 600. The BA driver 818 may be oriented towards the opening 600 of the inner housing 112 to emit sound out of wireless earbud 100 and into the ear canal of a user. The flex circuits 2100 are further shown operably coupling the IR sensor 116, the PCBA 816, and the BA driver 818. The flex circuits 2100 may also communicatively couple to the microphone 2202.

Figure 24A:
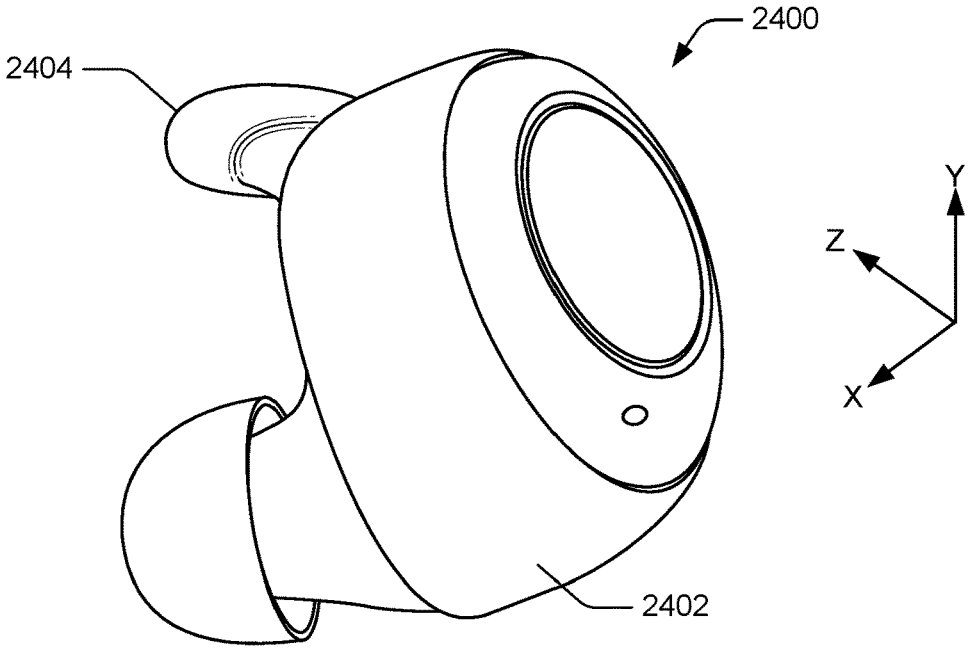
FIG. 24A illustrates a first perspective view of an example earbud, according to an embodiment of the present disclosure.
Figure 24B:
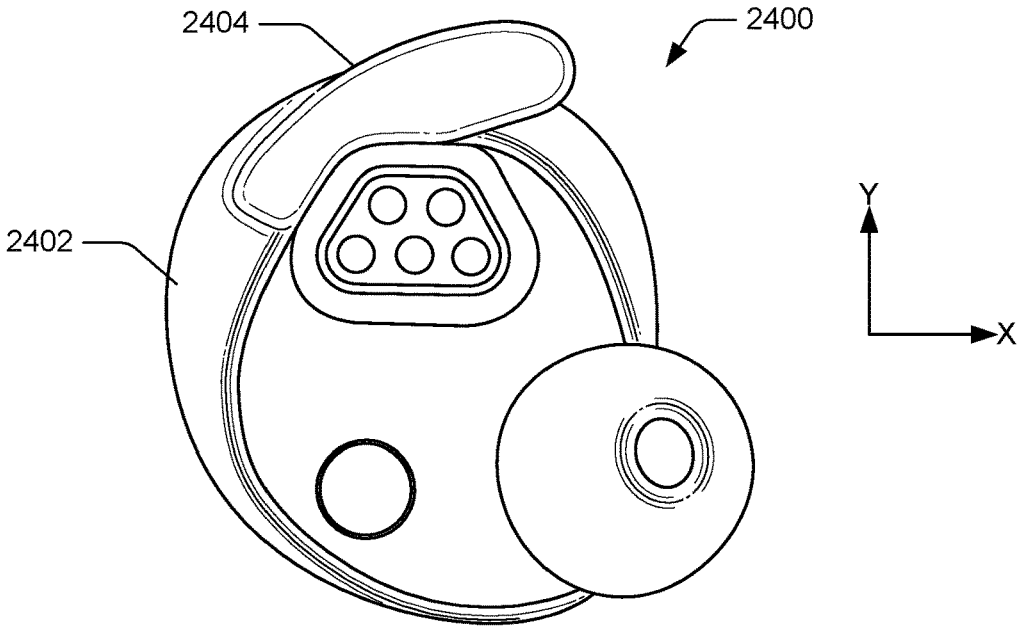
FIG. 24B illustrates a second perspective view of the earbud of FIG. 24A, according to an embodiment of the present disclosure.

FIGS. 24A and 24B illustrate perspective views of an alternate embodiment of a wireless earbud 2400. In some instances, the wireless earbud 2400 may include similar components or features as the wireless earbud 100, such as the outer housing assembly 700 (and components thereof), the internal assembly 702 (and components thereof), and/or the inner housing assembly 704 (and components thereof). However, as shown in FIGS. 24A and 24B, the wireless earbud 2400 may include an accessory, sleeve, or attachment 2402. The attachment 2402 may couple to a housing of the wireless earbud 2400, and may removably slide on and off a housing of the wireless earbud 2400. In some instances, the attachment 2402 may include a wing 2404 sized and configured to reside within the concha of the ear of the user. In some instances, the wing 2404 may secure the wireless earbud 2400 to the user when worn.

Figure 25:
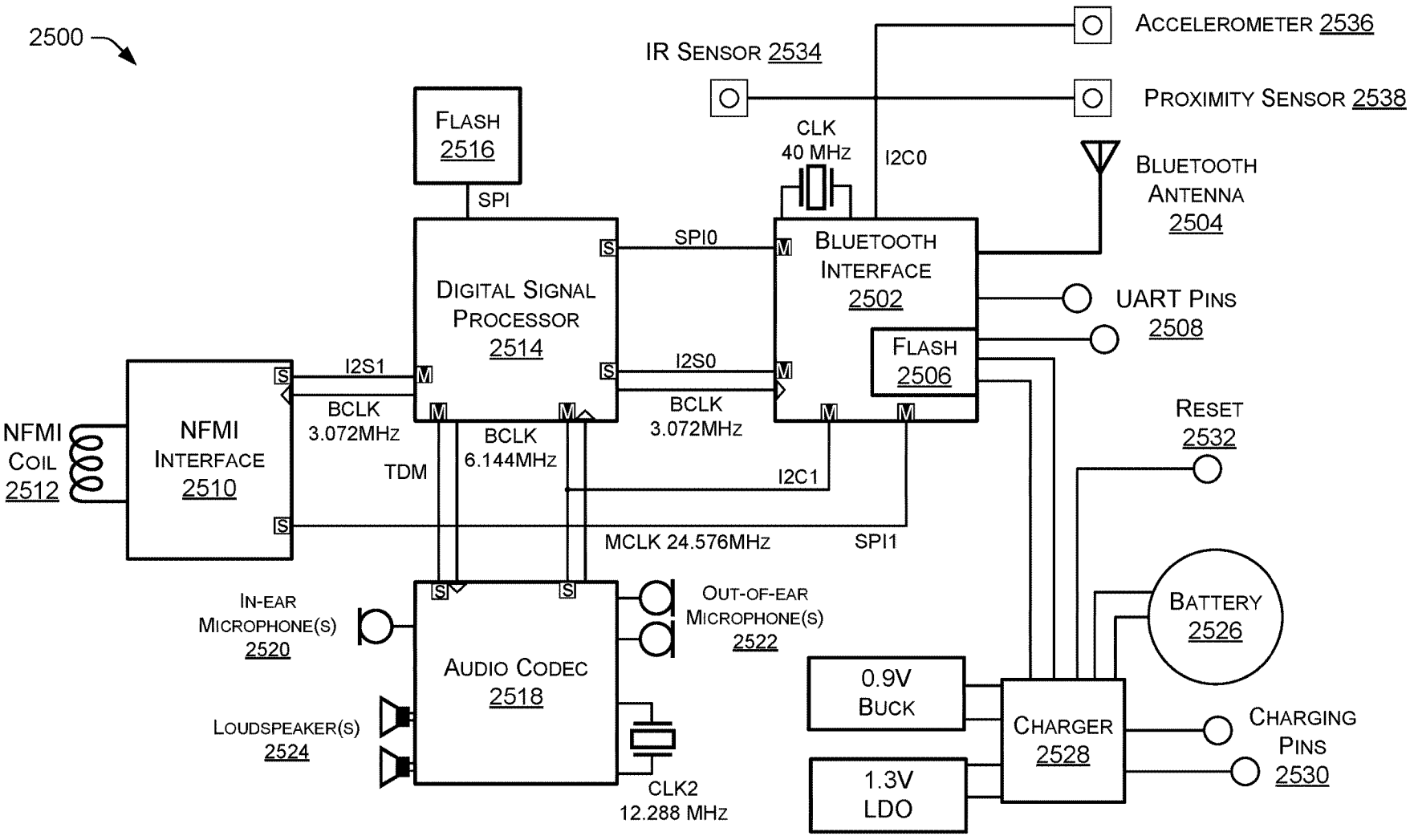
FIG. 25 illustrates an example architecture of an earbud, according to an embodiment of the present disclosure.

FIG. 25 illustrates an example architecture 2500 of a wireless earbud, such as the wireless earbud 100. The architecture 2500 may include a Bluetooth interface 2502 (e.g., SoC) used to connect the wireless earbud 100 to a phone, tablet, another wireless earbud, or other computing devices for voice and/or music streaming using hands free protocol (HFP) and advanced audio distribution profile (A2DP) profiles. In some instances, the Bluetooth interface 2502 may support dual-mode Bluetooth radios, such as Bluetooth classic and BLE. The architecture 2500 is also shown including a Bluetooth antenna 2504 (e.g., the antenna 200) coupled to the Bluetooth interface 2502. The Bluetooth interface 2502 may also include embedded flash memory 2506 (e.g., 2 MB). One or more universal asynchronous receiver and transmitter (UART) pins 2508 may receive and transmit serial data.

The architecture 2500 may include a NFMI interface 2510 having a NFMI coil 2512 (e.g., the NFMI coil 814).

In some instances, a first wireless earbud may communicatively couple to a mobile phone via Bluetooth, while a second wireless earbud may communicatively couple to the first wireless earbud via NFMI, which may be used to stream audio. Moreover, the first wireless earbud and the second wireless earbud may communicatively couple to one another via BLE, which may be used for control signaling (e.g., volume up, mute, answer phone call, etc.). In some instances, the first wireless earbud connected to the mobile phone may be designated as a primary earbud that performs voice processing, wake word detection, decoding audio data received from the mobile phone, and/or managing a voice call. The second wireless earbud connected to the first wireless earbud (e.g., primary earbud) via NFMI and BLE may be designated as a secondary earbud. In some instances, the secondary earbud may playback audio received from the primary earbud.

The architecture 2500 may include a DSP 2514 for processing audio data received at the wireless earbud. The DSP 2514 may include or communicatively couple to flash memory 2516 (e.g., 16 MB).

The architecture 2500 may include a codec 2518 to encode and decode audio signals, respectively. The codec 2518 may also convert audio data between analog and digital formats. The codec 2518 may couple to microphone(s) and loudspeaker(s) of the wireless earbud. For example, the codec 2518 may communicatively couple to in-ear microphone(s) 2520, out-of-ear microphone(s) 2522, and/or loudspeaker(s) 2524. In some instances, the in-ear microphone(s) 2520 may correspond to microphone(s) disposed within the ear canal of the user when worn (e.g., the microphone 2202) and the out-of-ear microphone(s) 2522 may correspond to microphone(s) that capture audio data external to the user (e.g., via microphone hole(s) on the first PCB 1400). In some instances, the loudspeaker(s) 2524 may correspond to the BA driver 818.

The architecture 2500 further includes a battery 2526 (e.g., the battery 808) for powering components of the wireless earbud. As shown, the battery 2526 may couple to a charger 2528 (e.g., 1.8V Buck) having charging pins 2530 for recharging the battery 2526. In some instances, the charger 2528 may correspond to the charging module 114 and the charging pins 2530 may correspond to the pins 1800 of the charging module 114. The charger 2528 may also include, or couple to a 0.9V buck converter and a 1.3V low dropout (LDO). The architecture 2500 may also include reset pins 2532 that connect to the charger 2528.

The architecture 2500 may include one or more sensor(s), such as an IR sensor 2534 (e.g., the IR sensor 116), an accelerometer 2536, and/or a proximity sensor 2538 (e.g., the proximity sensor 1112).

The architecture 2500 further illustrates that components may communicate via various communication protocols, such as serial peripheral interface (SPI), inter-integrated circuit (I2C), time-division multiplexing (TDM), etc.

Although the architecture 2500 illustrates certain components or is described as performing certain function, the architecture 2500 may further include additional and/or alternatively components than shown (e.g., PCBs, processors, memory, circuits, transformers, power supplies, etc.).

Figure 26:
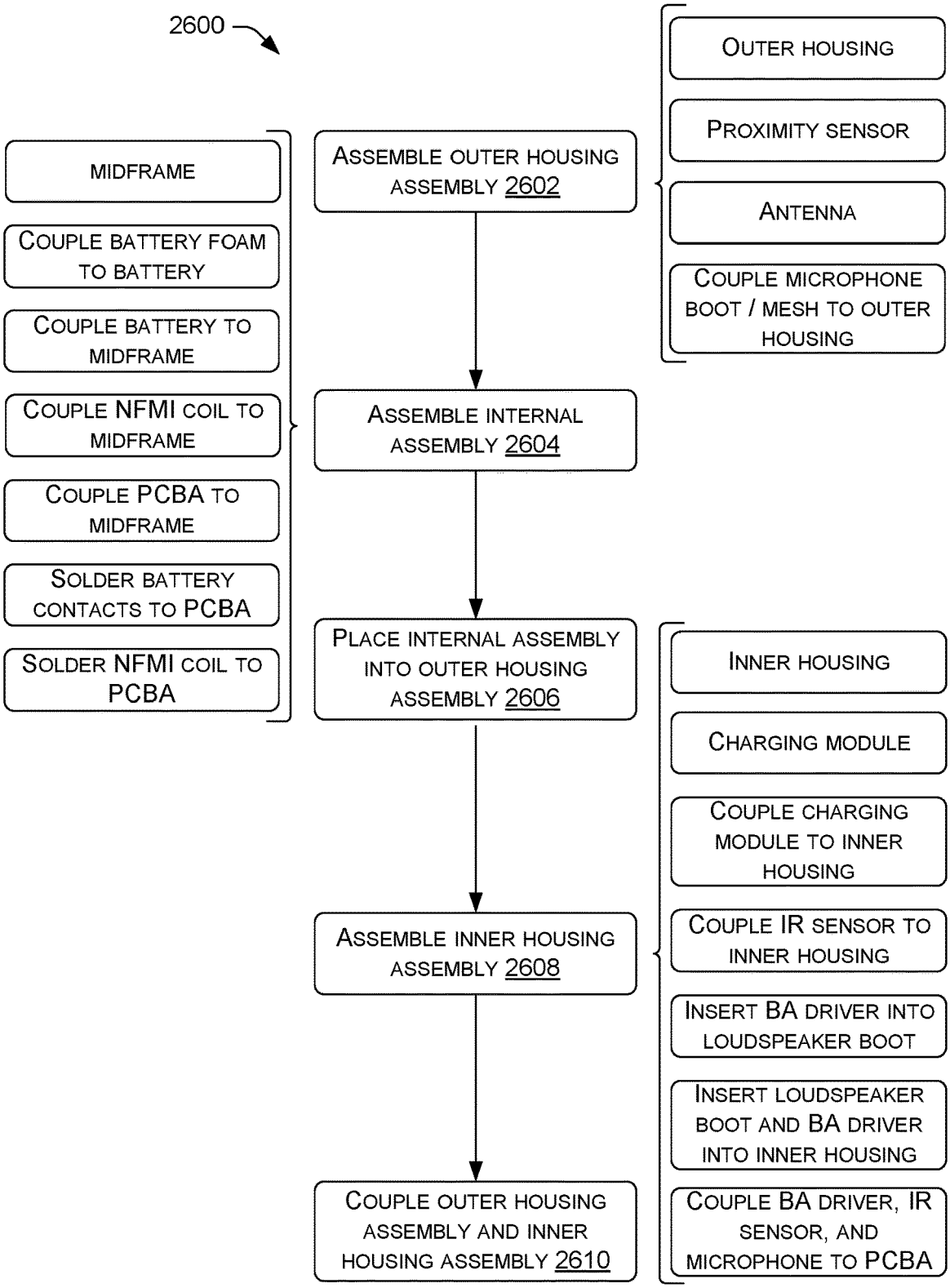
FIG. 26 illustrates an example process for assembling components of an example earbud, according to an embodiment of the present disclosure.

FIG. 26 illustrates an example process 2600 for assembling components of a wireless earbud, such as the wireless earbud 100. The processes described herein are illustrated as collections of blocks in logical flow diagrams, which represent a sequence of operations. The order in which the blocks are described should not be construed as a limitation, unless specifically noted. Any number of the described blocks may be combined in any order to implement the process, or alternative processes.

At 2602, the process 2600 may include assembling the outer housing assembly 700. In some instances, assembling the outer housing assembly 700 may include manufacturing the outer housing 110 using injection molding. After manufacturing the outer housing 110, the antenna 200 and/or the proximity sensor 1112 may be formed onto the outer housing 110. In some instances, the proximity sensor the antenna 200 and/or the proximity sensor 1112 may be formed using LDS. Additionally, in some instances, the proximity sensor 1112 may be formed within the interior 1110 of the outer housing 110 and the antenna 200 may be formed on the exterior surface 202 of the outer housing 110. Additionally, assembling the outer housing assembly 700 may include coupling the first microphone mesh 800 and first microphone boot 804 to the outer housing 110, and coupling the second microphone mesh 802 and second microphone boot 806 to the outer housing 110.

At 2604, the process 2600 may include assembling the internal assembly 702. In some instances, assembling the internal assembly 702 may include manufacturing the midframe 812 using injection molding. Thereafter, the battery foam 810 may be disposed on the battery 808 and secured thereto using tape or glue. For example, the battery foam 810 may be placed on opposing sides or surfaces of the battery 808 to protect against shorting and/or impact. The battery 808 (and battery foam 810) may then be placed into the midframe 812. For example, the battery 808 may be disposed within the first side 1300 of the midframe 812. In some instances, the battery 808 may be secured within or to the midframe 812 using adhesives. The NFMI coil 814 may also be coupled to the midframe 812, such as within the slot 1322 of the midframe 812. In some instances, the NFMI coil 814 may be secured within the slot 1322 using adhesives. The PCBA 816 may therein couple to the midframe 812. For example, the first PCB 1400 may couple to the first side 1300 of the midframe 812 and the second PCB 1402 may couple to the second side 1302 of the midframe 812. In some instances, the first PCB 1400 may couple to the midframe 812 first, and then the second PCB 1402 may fold over the exterior surface 1306 of the midframe 812 to dispose the second PCB 1402 adjacent to the second side 1302 of the midframe 812. After coupling the PCBA 816 to the midframe 812, the terminals of the battery 808 may be soldered to the PCBA 816 (e.g., the negative terminal may solder to the first PCB 1400 and the positive terminal may solder to the second PCB 1402). Additionally, wires or contacts of the NFMI coil 814 may solder to the PCBA 816, such as the second PCB 1402.

At 2606, the process 2600 may include placing the internal assembly 702 within the outer housing assembly 700. For example, the alignment elements 1316 of the midframe 812 may align with the alignment elements 1110 of the outer housing 110 to position the midframe 812 within the outer housing 110.

At 2608, the process 2600 may include assembling the inner housing assembly 704. In some instances, assembling the internal assembly 702 may include manufacturing the inner housing 112 using injection molding, and manufacturing the charging module 114 using injection molding and MIM techniques. The charging module 114 may then be placed or disposed through the opening 1704 in the inner housing 112, such that the first ends 1806 of the pins 1800 are oriented external to the wireless earbud 100 to couple to a charger and/or case. Additionally, the IR sensor 116 may be placed or disposed through the opening 1706. In some instances, glue may be disposed along seams of the charging module 114 and/or the IR sensor 116. Additionally, or alternatively, tape may be used to secure the charging module 114 and/or the IR sensor 116 to the inner housing 112. The BA driver 818 may be placed into the loudspeaker boot 820, and therein the BA driver 818 and loudspeaker boot 820 may be placed into the neck 300 (or pocket 1720) of the inner housing 112 such that that the BA driver 818 is oriented towards the opening 600 in the inner housing 112. In some instances, tape or glue may be used to secure the BA driver 818 and/or the loudspeaker boot 820 within the inner housing 112. Therein, the flex circuit(s) 2100 may be used to communicatively couple the BA driver 818, the IR sensor 116, and/or the microphone 2002 to the PCBA 816, such as the second PCB 1402.

At 2610, the process 2600 may include coupling the outer housing assembly 700 and the inner housing assembly 704. For example, the first attachment mechanism 302 of the outer housing 110 may operably engage with the second attachment mechanism 304 of the inner housing 112 to form a watertight seal for the internal assembly 702. Additionally, the alignment elements 1100 of the outer housing 110, the alignment elements 1316 of the midframe, and/or the alignment elements 1710 may align with one another. In some instances, the outer housing 110 and the inner housing 112 may further secure together using adhesives.

While various examples and embodiments are described individually herein, the examples and embodiments may be combined, rearranged and modified to arrive at other variations within the scope of this disclosure.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

The invention claimed is:

1. A device comprising:

a first housing including a first opening;

a second housing configured to couple to the first housing, the second housing including a second opening and a third opening;

a battery;

a frame residing at least partly within at least one of the first housing or the second housing, the frame including one or more sidewalls that define a cavity in which the battery is at least partly disposed, the one or more sidewalls at least partly annularly extending around the battery;

a microphone oriented towards the first opening;

an antenna disposed on an interior surface of the first housing;

a charging module extending at least partly into or at least partly through the second opening;

a loudspeaker oriented to emit sound towards the third opening; and a printed circuit board (PCB) coupled to the frame, the PCB including a contact that communicatively couples to the antenna.

2. The device of claim 1, wherein the first housing and the second housing form a substantially water-tight enclosure to inhibit liquid from reaching an interior of the device.

3. The device of claim 1, wherein the second housing further includes one or more magnetic elements arranged proximate the second opening.

4. The device of claim 1, further comprising at least one of:

a first mesh disposed at least partly over the first opening, the first mesh substantially permitting sound to reach the microphone while substantially inhibiting ingress of liquid; or a second mesh disposed at least partly over the third opening, the second mesh substantially permitting the sound output via the loudspeaker to exit the third opening while substantially inhibiting ingress of liquid.

5. The device of claim 1, further comprising a touch interface disposed at least one of on or within the first housing.

6. The device of claim 1, wherein:

the frame includes one or more tabs; and the one or more tabs engage with the PCB for aligning the PCB on the frame.

7. An ear-worn device comprising:

a first housing;

a second housing configured to couple to the first housing;

a microphone oriented towards a first opening defined by the first housing;

a frame;

a battery disposed within and at least partly encircled by the frame;

a loudspeaker at least partially disposed within the second housing and oriented towards a second opening defined by the second housing; and a printed circuit board (PCB) coupled to the frame, the microphone being disposed on the PCB.

8. The ear-worn device of claim 7, further comprising a charging module, wherein a portion of the charging module extends at least partly into or at least partly through a third opening defined by the second housing.

9. The ear-worn device of claim 7, wherein:

a coupling of the first housing and the second housing defines a cavity of the ear-worn device;

one or more computing components reside within the cavity; and the first housing and the second housing form a substantially water-tight enclosure to inhibit liquid from reaching the one or more computing components.

10. The ear-worn device of claim 7, further comprising a touch-sensitive interface at least one of disposed on or within the first housing.

11. The ear-worn device of claim 7, further comprising one or more magnetic elements.

12. The ear-worn device of claim 7, wherein:

the first housing includes at least one of a first alignment element or a first attachment mechanism;

the second housing includes at least one of a second alignment element or a second attachment mechanism; and at least one of:

the first alignment element and the second alignment element are configured to align the first housing and the second housing, or the first attachment mechanism and the second attachment mechanism are configured to couple the first housing and the second housing.

13. The ear-worn device of claim 7, wherein the second housing further defines a third opening.

14. An audio device comprising:

a first housing;

a second housing configured to couple to the first housing;

first computing components coupled to the first housing;

second computing components coupled to the second housing;

a connector communicatively coupling the first computing components and the second computing components;

a charging module;

a third housing coupled to at least one of the first housing or the second housing, the third housing including one or more alignment mechanisms for aligning the charging module within the audio device; and a battery disposed at least partially within the third housing.

15. The audio device of claim 14, further comprising an infrared (IR) sensor, wherein:

the second housing defines a first opening and a second opening;

at least a portion of the charging module extends at least partly into or at least partly through the first opening; and at least a portion of the IR sensor extends at least partly into or at least partly through the second opening.

16. The audio device of claim 14, wherein:

the first computing components include at least one of:

a touch-sensitive interface, a first microphone, a second microphone, an antenna, or a first printed circuit board (PCB); and the second computing components include at least one of:

a third microphone, a second PCB, or a loudspeaker driver.

17. The audio device of claim 14, wherein the battery is disposed within a cavity of the third housing, and the battery is interposed between at least a portion of the first computing components and a portion of the second computing components.

18. The audio device of claim 14, wherein the first housing and the second housing form a substantially water-tight enclosure to inhibit liquid from reaching the first computing components and the second computing components.

19. The audio device of claim 14, further comprising a microphone, and wherein one of:

the first housing includes a first opening to permit sound to reach the microphone, or the second housing includes a second opening to permit sound to reach the microphone.

20. The audio device of claim 14, further comprising a magnetic element disposed proximate to the charging module.

* * * * *